United States Patent [19]

Singer

[11] 4,005,183

[45] Jan. 25, 1977

[54] HIGH MODULUS, HIGH STRENGTH CARBON FIBERS PRODUCED FROM MESOPHASE PITCH

[75] Inventor: Leonard Sidney Singer, Berea, Ohio

[73] Assignee: Union Carbide Corporation, New York, N.Y.

[22] Filed: Mar. 5, 1973

[21] Appl. No.: 338,147

Related U.S. Application Data

[63] Continuation-in-part of Ser. No. 239,490, March 30, 1972, abandoned.

[52] U.S. Cl. ..... 423/447.2; 208/44; 264/29.2; 264/176 F; 423/448; 423/447.4

[51] Int. Cl.[2] ..... C01B 31/07

[58] Field of Search ..... 423/445, 447, 448, 449; 264/29, 176 F; 208/22, 39, 44

[56] References Cited

UNITED STATES PATENTS

| | | | |
|---|---|---|---|
| 3,412,062 | 11/1968 | Johnson et al. | 423/447 |
| 3,595,946 | 7/1971 | Joo et al. | 423/447 X |
| 3,629,379 | 12/1971 | Otani | 423/447 X |
| 3,635,675 | 1/1972 | Ezekiel | 423/447 |
| 3,671,192 | 6/1972 | Ezekiel | 423/447 |
| 3,702,054 | 11/1972 | Araki | 264/29 |
| 3,716,607 | 2/1973 | Otani | 423/447 X |
| 3,718,574 | 2/1973 | Araki et al. | 208/44 |
| 3,723,605 | 3/1973 | Ram | 423/448 |
| 3,764,662 | 10/1973 | Roberts, Jr. | 423/447 |
| 3,767,741 | 10/1973 | Toyoguchi et al. | 423/447 |
| 3,787,541 | 1/1974 | Grindstaff et al. | 423/447 |

FOREIGN PATENTS OR APPLICATIONS

| | | | |
|---|---|---|---|
| 2,015,175 | 11/1970 | Germany | 423/447 |
| 1,310,769 | 3/1973 | United Kingdom | 423/447 |

OTHER PUBLICATIONS

Brooks et al. "Chemistry and Physics of Carbon" vol. 4, 1968, pp. 243–268.

Otani, Summary of Papers, Ninth Biennal Conference on Carbon, June 16–20, 1969, p. 29, Paper CP–16.

Otani "Carbon" vol. 4, 1966, pp. 425–432.

Otani "Bulletin of the Chemical Society of Japan" vol. 45, 1972, pp. 3710–3714.

*Primary Examiner*—Edward J. Meros

*Attorney, Agent, or Firm*—John S. Piscitello

[57] ABSTRACT

High modulus, high strength carbon fibers, having a highly oriented structure characterized by the presence of carbon crystallites preferentially aligned parallel to the fiber axis, are produced from carbonaceous pitches which have been transformed, in part, to a liquid crystal or so-called "mesophase" state. When heated to graphitizing temperatures, these fibers develop the three-dimensional order characteristic of polycrystalline graphite.

35 Claims, 48 Drawing Figures

X-Ray Diffraction Pattern Acenaphthylene Mesophase Pitch Fibers, As Drawn

X-Ray Diffraction Pattern Petroleum Mesophase Pitch Fibers, As Drawn

X-Ray Diffraction Pattern
Acenaphthylene Non-Mesophase
Pitch Fibers, As-Drawn

X-Ray Diffraction Pattern
Petroleum Non-Mesophase Pitch
Fibers, As Drawn

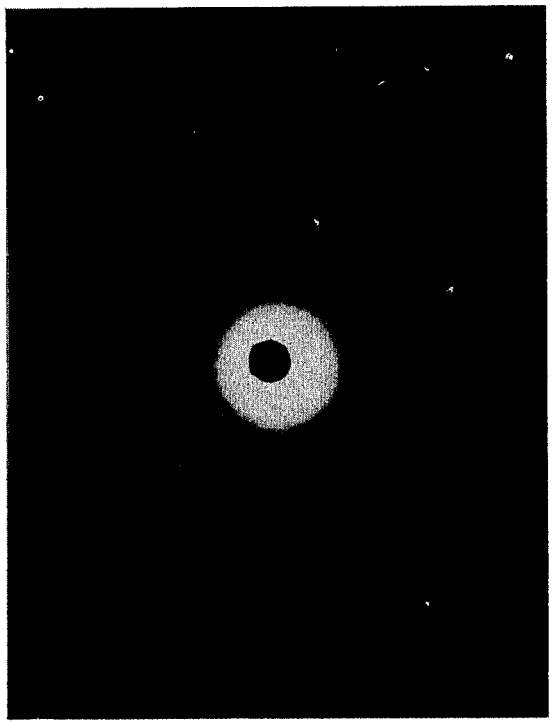
FIG. 5
X-Ray Diffraction Pattern
Acenaphthylene Non-Mesophase
Pitch Fibers Oxidized at 350°C.
and Carbonized at 1000°C.
FIG. 6
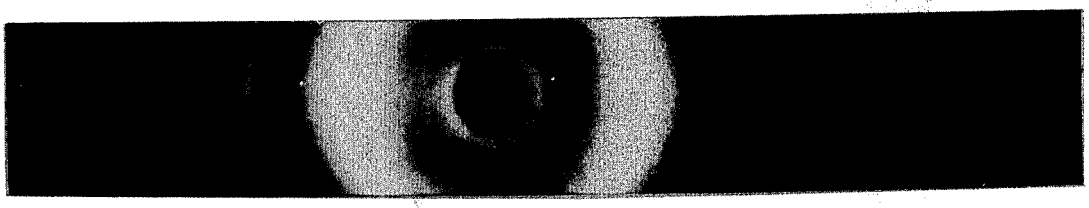
X-Ray Diffraction Pattern
Acenaphthylene Non-Mesophase Pitch Fibers
Oxidized at 350° C. and Heated to 3000° C.

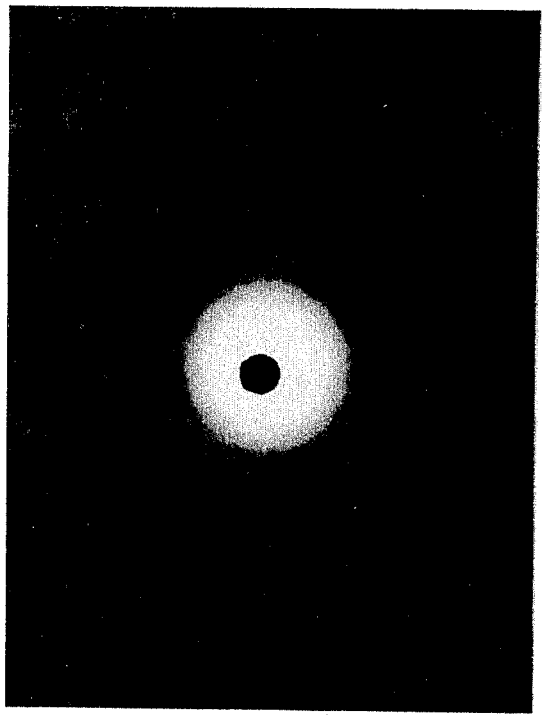
FIG. 7
X-Ray Diffraction Pattern
Petroleum Non-Mesophase Pitch
Fibers Oxidized at 350°C. and
Carbonized at 1000°C.
FIG. 8
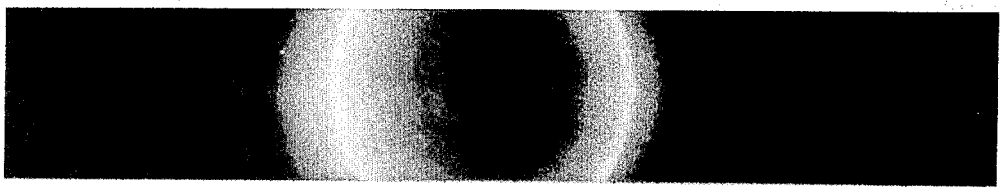
X-Ray Diffraction Pattern
Petroleum Non-Mesophase Pitch Fibers
Oxidized at 350°C. and Heated to 3000°C.

X-Ray Diffraction Pattern Acenaphthylene Mesophase Pitch Fibers Oxidized at 350° C and Carbonized at 1000° C X-Ray Diffraction Pattern Acenaphthylene Mesophase Pitch Fibers Oxidized at 350°C and Heated to 3000° C

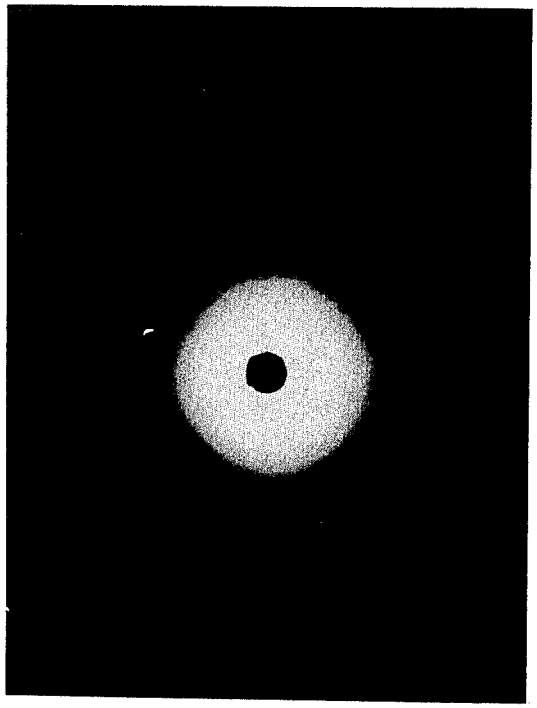
FIG. 11
X-Ray Diffraction Pattern Petroleum Mesophase Pitch Fibers Oxidized at 350°C and Carbonized at 1000°C
FIG. 12
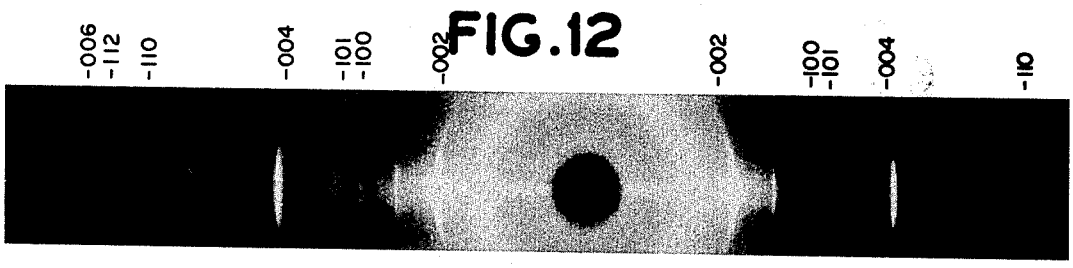
X-Ray Diffraction Pattern Petroleum Mesophase Pitch Fibers Oxidized at 350°C and Heated to 3000°C X-Ray Diffraction Pattern Polyacrylonitrile Fibers Oxidized at 200-250°C and Heated to 3000°C.

X-Ray Diffraction Pattern Rayon Fibers Thermally Stabilized in Air at 260-280°C and Heated to 3000°C

40 MICRONS

Polarized Light Micrograph Petroleum Mesophase Pitch Fibers, As Drawn, Cross Sections

40 MICRONS

Polarized Light Micrograph Petroleum Mesophase Pitch Fiber, As Drawn, Longitudinal Section

20 MICRONS

Polarized Light Micrograph
Petroleum Mesophase Pitch Fiber
Oxidized at 350°C. and Carbonized
at 1675°C., Cross Section

20 MICRONS

Polarized Light Micrograph
Petroleum Mesophase Pitch Fiber
Oxidized at 350°C. and Carbonized
at 1675°C., Longitudinal Section

20 MICRONS

Polarized Light Micrograph Petroleum Mesophase Pitch Fiber Oxidized at 350°C. and Heated to 3000°C., Cross Section

20 MICRONS

Polarized Light Micrograph Petroleum Mesophase Pitch Fiber Oxidized at 350°C. and Heated to 3000°C., Longitudinal Section Polarized Light Micrograph
Acenaphthylene Mesophase Pitch Fiber, As Drawn, Cross Section

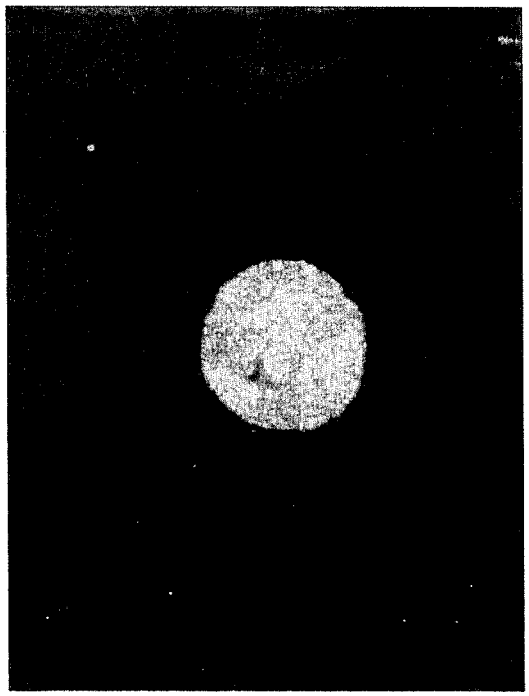
20 MICRONS
FIG. 22
Polarized Light Micrograph Acenaphthylene Mesophase Pitch Fiber Oxidized at 350°C and Carbonized at 1605°C, Cross Section
20 MICRONS
FIG. 23
Polarized Light Micrograph Acenaphthylene Mesophase Pitch Fiber Carbonized at 1600°C Without Prior Oxidation, Cross Section
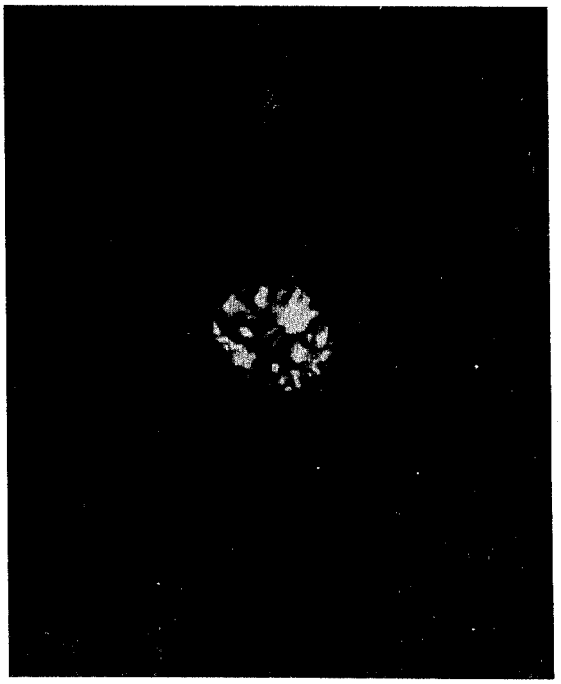

20 MICRONS

Polarized Light Micrograph Acenaphthylene Mesophase Pitch Fiber Oxidized at 350°C and Heated to 3000° C, Cross Section

20 MICRONS

Polarized Light Micrograph Acenaphthylene Mesophase Pitch Fiber Oxidized at 350°C and Heated to 3000° C, Longitudal Section

20 MICRONS

Polarized Light Micrograph Petroleum Non-Mesophase Pitch Fibers, As Drawn, Cross Sections

20 MICRONS

Polarized Light Micrograph Petroleum Non-Mesophase Pitch Fiber, As Drawn, Longitudinal Section

20 MICRONS

Polarized Light Micrograph Petroleum Non-Mesophase Pitch Fiber Oxidized at 340°C and Carbonized at 1600°C, Cross Section

20 MICRONS

Polarized Light Micrograph Petroleum Non-Mesophase Pitch Fiber Oxidized at 340°C and Carbonized at 1600°C, Longitudinal Section

20 MICRONS

Polarized Light Micrograph Petroleum Non-Mesophase Pitch Fibers Oxidized at 340°C. and Heated to 3000°C., Cross Sections

20 MICRONS

Polarized Light Micrograph Petroleum Non-Mesophase Pitch Fiber Oxidized at 340°C. and Heated to 3000°C., Longitudinal Section Polarized Light Micrograph
Acenaphthylene Non-Mesophase
Pitch Fibers, As Drawn,
Cross Sections

20 MICRONS

Polarized Light Micrograph Acenaphthylene Non-Mesophase Pitch Fiber Oxidized at 315 °C and Carbonized at 1505 °C, Cross Section

20 MICRONS

Polarized Light Micrograph Acenaphthylene Non-Mesophase Pitch Fiber Oxidized at 315 °C and Heated to 2000°C, Cross Section

20 MICRONS

Polarized Light Micrograph Acenaphthylene Non-Mesophase Pitch Fibers Oxidized at 350°C. and Heated to 3000°C., Cross Sections

20 MICRONS

Polarized Light Micrograph Acenaphthylene Non-Mesophase Pitch Fiber Oxidized at 350°C. and Heated to 3000°C., Longitudinal Section

20 MICRONS

Polarized Light Micrograph Polyacrylonitrile Fibers Oxidized at 200 - 250 °C and Heated to 400° C, Cross Sections

20 MICRONS

Polarized Light Micrograph Polyacrylonitrile Fibers Oxidized at 200 - 250° C and Heated to 400° C, Longitudinal Sections

20 MICRONS

Polarized Light Micrograph Polyacrylonitrile Fibers Oxidized at 200 - 250° C and Carbonized at 1400° C, Cross Sections

20 MICRONS

Polarized Light Micrograph Polyacrylonitrile Fibers Oxidized at 200 - 250° C and Carbonized at 1400° C, Longitudinal Sections

20 MICRONS

Polarized Light Micrograph Polyacrylonitrile Fibers Oxidized at 200°-250° C and Heated to 2800° C, Cross Sections

20 MICRONS

Polarized Light Micrograph Polyacrylonitrile Fibers Oxidized at 200°-250° C and Heated to 2800° C, Longitudinal Sections

20 MICRONS

Polarized Light Micrograph
Rayon Fibers Thermally Stabilized in Air at 260-280 °C. and Heated to 300°C., Cross Sections

20 MICRONS

Polarized Light Micrograph
Rayon Fibers Thermally Stabilized in Air at 260-280 °C. and Heated to 300 °C., Longitudinal Sections

20 MICRONS

Polarized Light Micrograph
Rayon Fibers Thermally Stabilized
in Air at 260-280°C. and Carbonized
at 1300°C., Cross Sections

20 MICRONS

Polarized Light Micrograph
Rayon Fibers Thermally Stabilized
in Air at 260-280°C. and Carbonized
at 1300°C., Longitudinal Sections

20 MICRONS

Polarized Light Micrograph
Rayon Fibers Thermally Stabilized
in Air at 260-280°C. and Heated
to 3000°C., Cross Sections

20 MICRONS

Polarized Light Micrograph
Rayon Fibers Thermally Stabilized
in Air at 260-280°C. and Heated
to 3000°C., Longitudinal Sections

HIGH MODULUS, HIGH STRENGTH CARBON FIBERS PRODUCED FROM MESOPHASE PITCH

CROSS REFERENCE TO RELATED APPLICATIONS

This application is a continuation-in-part of copending application Ser. No. 239,490, filed March 30, 1972, now abandoned.

BACKGROUND OF THE INVENTION

1. Field of the Invention

This invention relates to the production of carbon fibers having a high Young's modulus of elasticity and high tensile strength. More particularly, this invention relates to carbon fibers having a high Young's modulus and high tensile strength produced from pitch which has been transformed, in part, to a liquid crystal or so-called "mesophase" state.

2. Description of the Prior Art

As a result of the rapidly expanding growth of the aircraft, space and missile industries in recent years, a need was created for materials exhibiting a unique and extraordinary combination of physical properties. Thus, materials characterized by high strength and stiffness, and at the same time of light weight, were required for use in such applications as the fabrication of aircraft structures, re-entry vehicles, and space vehicles, as well as in the preparation of marine deep-submergence pressure vessels and like structures. Existing technology was incapable of supplying such materials and the search to satisfy this need centered about the fabrication of composite articles.

One of the most promising materials suggested for use in composite form was high-strength, high-modulus carbon textiles, which were introduced into the market place at the very time this rapid growth in the aircraft, space and missile industries was occurring. Such textiles have been incorporated in both plastic and metal matrices to produce composites having extraordinary high-strength- and high-modulus-to-weight ratios and other exceptional properties. However, the high cost of producing the high-strength, high-modulus carbon textiles employed in such composites has been a major deterrent to their wedespread use, in spite of the remarkable properties exhibited by such composites.

Most high-strength, high-modulus carbon textiles currently available are derived, for the most part, from rayon or acrylic fibers, and are inherently expensive as a result of the high cost of their precursors. In addition to the high cost of the starting materials, the poor carbon yield obtained from such precursors (of the order of 25 to 50 per cent) and the complex processing required to produce satisfactory carbon textiles therefrom materially contribute to the cost of the final product. Thus, carbon textiles prepared from rayon fibers at low temperatures are weak, porous and almost completely disordered in structure, with high modulus and high strength being obtained only by subjecting the fibers to longitudinal stress at high temperatures where the fibers become somewhat plastic. High strength and modulus are generally obtained in carbon textiles derived from acrylic fibers, on the other hand, by the application of longitudinal stress during a lengthy heat stabilization treatment prior to carbonization, generally in an oxygen-containing atmosphere, with the application of stress continued, if desired, during further heat treatment. In both instances, it is necessary to apply stress to the fibers in order to obtain the desired level of modulus and strength. In the case of rayon, the stress is applied at high temperatures in order to align the disordered crystallites present in the fiber parallel to the fiber axis and thereby increase the strength and modulus of the fiber. In the case of acrylic fibers, such as polyacrylonitrile, the precursor is already highly oriented and stress is generally applied prior to carbonization during the heat stabilization treatment in order to maintain this orientation while it is more permanently preserved by the cross-linking which occurs between the fiber molecules during the heat treatment. In either case, the application of stress causes frequent breakage of the fibers during processing, requires additional processing apparatus, and materially contributes to the cost of the fiber.

Rayon and acrylic fibers are not only expensive and difficult to process to carbon textiles, but they are also "non-graphitizing" materials incapable of being substantially converted by heat treatment to the three-dimensional crystalline structure characteristic of polycrystalline graphite. While carbon produced from most carbonaceous precursors can to some degree be transformed by further heat treatment from the less ordered structure of the carbonized product to a structure which more nearly resembles the three-dimensional crystalline structure characteristic of polycrystalline graphite, only carbon produced from certain so-called "graphitizable" or "graphitizing" materials, such as petroleum coke, are capable of full development of a graphite structure and graphitic-like properties associated therewith, such as high density and low electrical resistance. Rayon and acrylic fibers, as is characteristic of materials which pyrolyze to a char without melting, are among those materials which are incapable of forming large crystallites having a high degree of three-dimensional order. Despite this, fibers produced by pyrolysis of such materials have traditionally been classified as carbonized or graphitized on the basis of their elemental carbon content or the temperature to which they have been heated. Thus, for example, Schmidt and Jones have classified fibers prepared at temperatures ranging from 1300° F. to 1700° F (704° C. to 927° C.) as partially carbonized or carbonized, while fibers processed at 4900° F. to 5400° F. (2704° C. to 2982° C.) are classified as graphite; similarly, fibers having an elemental carbon content up to 90 weight percent are classified as "partially carbonized", while fibers having an elemental carbon content in the range of 91 to 98 weight percent are classified as carbonized, and fibers having an elemental carbon content in excess of 98 weight percent are classified as graphite (Schmidt, D. L. and Jones, W. C., "Carbon-Base Fiber Reinforced Plastics," AFML, WPAFB, Dayton, Ohio. ASD-TDR-62-635, August, 1962). Such classification methods, however, fail to take into consideration the actual crystal structure of the fiber. Thus, for example, by such methods of classification, a graphitized fiber could be one processed at a very high temperature or one having a very high elemental carbon content, even though prepared from a non-graphitizing precursor and substantially devoid of the three-dimensional crystalline structure characteristic of polycrystalline graphite.

While high-modulus, high strength carbon fibers prepared by processing rayon and acrylic fibers to temperatures of from 2500° C. to 300° C. and higher, develop certain incipient graphitic-like properties with increasing temperature, such as high density, high carbon content, and low electrical resistivity, the fibers, as aforementioned, are incapable of full development of the three-dimensional ordered structure of polycrystalline graphite: As the fibers are heated to a temperature sufficiently high to produce a substantially all-carbon fiber, e.g., to a temperature of about 1000° C., planes of carbon atoms arranged in polynuclear aromatic rings and stacked parallel to each other gradually develop within the fiber. On further heating above about 1000° C., these stacks, or crystallites, continue to grow in size, either by coalescence with other crystallites or by the incorporation of surrounding disorganized carbon atoms, and on heating to so-called graphitizing temperatures, the layer planes within the crystallites begin to rearrange themselves somewhat by mutual rotation and shifting. However, both crystallite growth and rotation of the layer planes within each crystallite is minimal, and the resulting crystallites are both small and turbostratic, i.e., although the layer planes within the crystallites are all essentially parallel to each other, extensive rotational misalignment of these layers relative to each other exists. While the application of longitudinal stress to the fibers (at high temperatures in the case of rayon or during heat stabilization in the case of acrylic fibers) produces some ordering in the fiber structure by aligning these crystallites parallel to the longitudinal fiber axis, each crystallite still remains turbostratic and essentially devoid of the three-dimensional order of polycrystalline graphite, even after heating to high temperatures. The preferred orientation of the crystallites parallel to the longitudinal fiber axis imparts high modulus and strength to the fibers, but the failure of the carbon planes within each crystallite to align themselves relative to each other prevents the fibers from developing truly graphitic properties, e.g., high thermal and electrical conductivity.

The high degree of preferred orientation of the fiber crystallites of high-modulus, high-strength carbon fibers prepared by processing rayon and acrylic fibers to temperatures of from 2500° C. to 3000° C., and higher, is clearly established by the short arcs which constitute the (00*l*) bands of the X-ray diffraction pattern of these fibers. The turbostraticity of these crystallites, i.e., the misalignment of the parallel layers within the crystallite relative to each other, is evident from the absence of the (112) cross lattice line in the pattern and the lack of resolution of the broad (10) diffraction band into two distinct lines, (100) and (101). The lack of three-dimensional order within the crystallites is further indicated by the relatively high interlayer spacing ($d$) of the layer planes, which has been shown to exceed 3.40 A in the case of fibers prepared from polyacrylonitrile or rayon. This measurement is calculated from the distance between the corresponding (00*l*) lines of the X-ray diffraction pattern and has been related by R. E. Franklin to the proportion of disoriented layers, or disorientation parameter $p$ of carbon (R. E. Franklin, Acta Cryst., 4, 253, 1951).[1] Based on the relationship shown by Franklin, the disorientation parameter $p$ of fibers prepared from either polyacrylonitrile or rayon exceeds 0.7. It is considered that carbon which after undergoing heat treatment to 3000° C. has an interlayer spacing $d_{002}$ greater than 3.40 A or a disorientation parameter $p$ greater than 0.7 is a non-graphitizing carbon, while carbon which after undergoing heat treatment to 3000° C. has an interlayer spacing $d_{002}$ less than 3.37 A or a disorientation parameter of less than 0.4 is well-graphitizing or graphitic (see, e.g. U. K. patent No. 1,220,482).

(1) The proportion of disoriented layers $p$ was calculated from the (112) line on the assumption of a randon distribution of orientations and disorientations. This measurement was then related to the interlayer spacing $d_{002}$ assuming there exist only three interlayer spacings, 3.354 A at an orientation or at a disorientation isolated between two orientations, 3.399 A at the first disorientation on either side of an oriented group, and 3.440 A at all other disorientations.

In addition to having an interlayer spacing greater than about 3.40 A and a disorientation parameter greater than about 0.7, the crystallites of high-modulus, high-strength carbon fibers prepared by processing rayon and acrylic fibers to temperatures of from 2500° C. to 3000° C., and higher, are considered to be non-graphitic in that they are incapable of developing a crystallite size characteristic of graphitic carbon, i.e., a layer size ($L_a$) and a stack height ($L_c$) in excess of 500 A. Thus, the apparent layer size ($L_a$) of the crystallites of these materials does not exceed 200 A, while the apparent stack height ($L_c$) does not exceed 100 A. Because of their small size, these crystallites are incapable of being detected by conventional polarized light microscopy techniques at a magnification of 1000.[2]

(2) The maximum resolving power of a standard polarized light microscope having a magnification factor of 1000 is only a few tenths of a micron (1 micron = 10,000 A). Thus, crystallites having dimensions of 1000 A or less cannot be detected by this technique.

While Jackson and Marjoram (Jackson, P. W. and Marjoram, J. R., Nature, Vol. 218, pages 83–84, Apr. 6, 1968) have reported that carbonized fibers prepared by controlled pyrolysis of polymer fiber up to 1000° C. and graphitized fibers prepared by further treatment up to 2700° C. may be recrystallized to produce graphitized fibers having extensive three-dimensional order and a crystallite size of 500 A by coating the fibers with nickel and heating above 1000° C. for 24 hours, such recrystallization is accompanied by a drastic reduction in the strength of the fibers. The weakened fibers are, of course, difficult to separate from their nickel coating, prohibitively expensive to make, and unsuitable for preparing composites having high-strength- and high-modulus-to-weight ratios.

In addition to rayon and acrylic fibers, various natural and synthetic pitches have been suggested as precursor materials for carbon textiles. Although these materials are suitable for the production of carbon fibers because of their high carbon content and ability to form spinnable melts, the thermoplastic nature of pitch makes it impossible to carbonize fibers drawn therefrom without first thermosetting the fibers to ensure preservation of the filament shape during carbonization. Thermosetting is generally accomplished by extended heating in air or other oxygen-containing atmosphere until the fibers are rendered infusible. However, such treatment not only renders the fibers infusible but also inhibits crystallite growth and alignment during subsequent heat treatment and prevents the fibers from developing a graphitic structure. Consequently, the carbon fibers produced are composed of small turbostratic crystallites which do not possess the high degree of crystallite orientation along the fiber axis ordinarily associated with high fiber modulus.

The first publication on the subject of producing carbon fibers from pitch (Otani, S., "On the Carbon Fiber from the Molten Pyrolysis Products," Carbon 3, 31–38, 1965) did not deal with commercial pitches, such as coal tar pitch or petroleum pitch, but with a specially prepared pitch produced by pyrolyzing polyvinyl chloride at a temperature of about 400° C. – 415° C. for 30 minutes or more in a nitrogen atmosphere.

This method proposed making carbon fibers from such pitch by melt spinning the pitch to produce a fiber, oxidizing the fiber with ozone below 70° C. and/or in air up to 260° C. to produce an infusible fiber, and subsequently carbonizing the fiber to a temperature of 500° C. to 1350° C. in a nitrogen atmosphere. Although the fibers prepared in this manner were composed of glassy carbon, tensile strengths of up to about $18 \times 10^6$ g/cm$^2$ (256,000 psi.) were reported. However, the highest modulus obtained for such fibers was less than $5 \times 10^8$ g/cm$^2$ ($8 \times 10^6$ psi.), evidently due to the lack of crystallite orientation within the fiber. When the residual tarry material formed as a by-product in the production of benzylchloride by the reaction of chlorine and toluene was employed as starting material, almost identical fibers were said to have been obtained.

Later, the preparation and properties of carbon fibers spun from petroleum asphalt and coal-tar pitch was discussed by Otani (Otani, S., Yamada, K., Koitabashi, T., and Yokoyama, A., "On the Raw Materials of MP Carbon Fiber," Carbon 4, 425–432, 1966). These materials were spun into fibers at temperatures between 200° C. and 370° C. after being first dry distilled (by bubbling nitrogen gas through the pitch) at about 380° C. for 60 minutes and then vacuum distilled at 380° C., or less, for 60–80 minutes. In the case of the coal tar pitch, additional heating at 280° C. under nitrogen after adding dicumilperoxide was necessary to improve spinnability at high speeds. The spun fibers were rendered infusible by oxidizing in ozone at 60° C. to 70° C. and then in air to 260° C., and were subsequently carbonized by heating to 1000° C. in a nitrogen atmosphere. The properties of fibers drawn from petroleum asphalt were similar to those of fibers which had been prepared from polyvinyl chloride pitch, but fibers prepared from coal tar pitch were lower in strength and more difficult to spin. Fibers prepared from mixtures of petroleum asphalt and coal tar pitch more nearly resembled fibers prepared from petroleum asphalt than fibers prepared from coal tar pitch.

More recently, Hawthorne et al. reported that the tensile strength and Young's modulus of carbon fibers produced from petroleum asphalt and other pitches in a manner similar to that employed by Otani et al. may be raised from $250 \times 10^3$ psi. and $3–7 \times 10^6$ psi., respectively, to $375 \times 10^3$ psi. and $70 \times 10^6$ psi., respectively, by elongating the fibers at a temperature of from 2000° C. to 2800° C. (Hawthorne, H. M., Baker, C., Bentall, R. H., and Linger, K. R., "High Strength, High Modulus Graphite Fibres from Pitch," Nature 227, 946–947, Aug. 29, 1970). The structure of the fibers produced in this manner were said to resemble the structure previously observed in rayon and polyacrylonitrile graphite fibers. As with fibers derived from these earlier precursors, however, although the application of longitudinal stress to the fibers produces a high degree of orientation of the fiber crystallites parallel to the longitudinal fiber axis, each crystallite remains turbostratic and essentially devoid of the three-dimensional order characteristic of polycrystalline graphite.

In a still later report, Hawthorne more fully discussed the structure of fibers made by high temperature stretching of the glassy carbon fibers derived from pitches and like precursors (Hawthorne, H. M., "Structure and Properties of Strain-Graphitized Glassy Carbon Fibres," International Conference on Carbon Fibres, their composites and Applications, The Plastics Institute, Paper No. 13, 13/1–13/13, London, 1971). The X-ray diffraction characteristics of these fibers were said to be generally similar to polyacrylonitrile- and rayon-based fibers in that no reflections other than (00*l*) lines and (hk) bands are present, consistent with the turbostratic nature of these fibers. The fiber crystallites were shown to have a large d-spacing ( $\geqq$ 3.40 A) and small apparent crystallite size ($L_a \leqq$ 136 A; $L_c \leqq$ 145 A), which are characteristic of glassy carbons. Fibrils having widths of up to 300 A and granular domains 800–900 A in diameter were indicated.

Otani et al. have further reported that carbon fibers having a high degree of preferred orientation of carbon crystallites parallel to the fiber axis can be obtained from pitch materials not only by applying stress at high temperatures to fibers drawn from such materials, in the manner of Hawthorne et al., but also, without the application of stress, from a pitch which possesses highly-oriented molecules that is prepared from tetrabenzophenazine (Otani, S., Kokubo, Y., Koitabashi, T., "The Preparation of Highly-oriented Carbon Fiber from Pitch Material", Bulletin of the Chemical Society of Japan, 43, 3291–3292, October, 1970). However, the method of preparing such fibers was not disclosed. Although fibers prepared from such pitch were reported to be highly oriented, such fibers were not indicated to have a graphitic-like structure or to in any way differ from highly oriented carbon fibers earlier prepared from pitch precursors by the application of stress at high temperatures.

Thus, although it is well known that pitch materials can be transformed by heat treatment at elevated temperatures from an isotropic structure to one containing domains of highly oriented molecules (Brooks, J. D., and Taylor, G. H., "The Formation of Some Graphitizing Carbons," *Chemistry and Physics of Carbon*, Vol. 4, Marcel Dekker, Inc., New York, 1968, pp. 243–268; White, J. R., Guthrie, G. L., and Gardner, J. O., "Mesophase Microstructures in Carbonized Coal Tar Pitch," Carbon 5, 517, 1968; and Dubois, J., Agache, C., and White, J. L., "The Carbonaceous Mesophase Formed in the Pyrolysis of Graphitizable Organic Materials," Metallography 3, 337–369, 1970), no method for converting such materials into carbon fibers having the three-dimensional crystalline structure characteristic of polycrystalline graphite has been reported. Carbon fibers having such structures are still unknown, and, to date, all high modulus, high strength carbon fibers derived from pitch precursors, whether by high temperature stretching or directly from high oriented pitch precursors in the absence of stress, differ little in structure from high modulus, high strength carbon fibers produced from rayon or acrylic precursors. Although all such fibers, regardless of precursor, are characterized by the presence of carbon crystallites preferentially aligned parallel to the fiber axis, none possesses the three-dimensional order characteristic of polycrystalline graphite.

SUMMARY OF THE INVENTION

In accordance with the instant invention, it has now been discovered that carbonaceous fibers having a high degree of preferred orientation of their molecules parallel to the fiber axis can be spun, e.g., by melt spinning techniques, from certain suitable carbonaceous pitches which have been transformed, in part, to a liquid crystal or so-called mesophase state; and that such fibers can be converted by further heat treatment into carbon fibers having a high Young's modulus of elasticity and high tensile strength. The carbon fibers so produced not only have a highly oriented structure characterized by the presence of carbon crystallites preferentially aligned parallel to the fiber axis, but when heated to graphitizing temperatures they develop the three-dimensional order characteristic of polycrystalline graphite and graphitic-like properties associated therewith, such as high density and low electrical resistance. At all stages of their development from the as-drawn condition to the graphitized state the fibers are characterized by the presence of large oriented elongated graphitizable domains preferentially aligned parallel to the fiber axis.

DESCRIPTION OF THE PREFERRED EMBODIMENTS

Natural and synthetic pitches, as is well known, are complex mixtures of organic compounds which, except for certain rare paraffinic-base pitches derived from certain petroleums, such as Pennsylvania crude, are made up essentially of fused ring aromatic hydrocarbons and are, therefore, said to have an aromatic base. Since the molecules which make up these organic compounds are comparatively small (average molecular weight not more than a few hundred) and interact only weakly with one another, such pitches are isotropic in nature. On heating these pitches under quiescent conditions at a temperature of about 350°–450° C., however, either at constant temperature of with gradually increasing temperature, small insoluble liquid spheres begin to appear in the pitch which gradually increase in size as heating is continued. When examined by electron diffraction and polarized light techniques, these spheres are shown to consist of layers of oriented molecules aligned in the same direction. As these spheres continue to grow in size as heating is continued, they come in contact with one another and gradually coalesce with each other to produce larger masses of aligned layers. As coalescence continues, domains of aligned molecules much larger than those of the original spheres are formed. These domains come together to form a bulk mesophase wherein the transition from one oriented domain to another sometimes occurs smoothly and continuously through gradually curving lamellae and sometimes through more sharply curving lamellae. The differences in orientation between the domains create a complex array of polarized light extinction contours in the bulk mesophase corresponding to various types of linear discontinuity in molecular alignment. The ultimate size of the oriented domains produced is dependent upon the viscosity, and the rate of increase of the viscosity, of the mesophase from which they are formed, which, in turn are dependent upon the particular pitch and the heating rate. In certain pitches, domains having sizes in excess of two hundred microns up to several hundred microns are produced. In other pitches, the viscosity of the mesophase is such that only limited coalescence and structural rearrangement of layers occur, so that the ultimate domain size does not exceed one hundred microns.

The highly oriented, optically anisotropic, insoluble material produced by treating pitches in this manner has been given the term "mesophase", and pitches containing such material are known as "mesophase pitches". Such pitches, when heated above their softening points, are mixtures of two immiscible liquids, one the optically anisotropic, oriented mesophase portion, and the other the isotropic non-mesophase portion. The term "mesophase" is derived from the Greek "mesos" or "intermediate" and indicates the pseudo-crystalline nature of this highly-oriented, optically anisotropic material.

Carbonaceous pitches having a mesophase content of from about 40 per cent by weight to about 90 per cent by weight are suitable for producing highly oriented carbonaceous fibers capable of developing the three-dimensional order characteristic of polycrystalline graphite according to the invention. In order to obtain the desired fibers from such pitch, however, the mesophase contained therein must, under quiescent conditions, form a homogeneous bulk mesophase having large coalesced domains, i.e., domains of aligned molecules in excess of two hundred microns up to several hundred microns in size. Pitches which form stringy bulk mesophase under quiescent conditions, having small oriented domains, rather than large coalesced domains, are unsuitable. Such pitches form mesophase having a high viscosity which undergoes only limited coalescense, insufficient to produce large coalesced domains having sizes in excess of two hundred microns. Instead, small oriented domains of mesophase agglomerate to produce clumps or stringy masses wherein the ultimate domain size does not exceed one hundred microns. Certain pitches which polymerize very rapidly are of this type. Likewise, pitches which do not form a homegeneous bulk mesophase are unsuitable. The latter phenomenon is caused by the presence of infusible solids (which are either present in the original pitch or which develop on heating) which are enveloped by the coalescing mesophase and serve to interrupt the homogeneity and uniformity of the coalesced domains, and the boundaries between them.

Another requirement is that the pitch be nonthixotropic under the conditions employed in the spinning of the pitch into fibers, i.e., it must exhibit a Newtonian or plastic flow behavior so that the flow is uniform and well behaved. When such pitches are heated to a temperature where they exhibit a viscosity of from about 10 poises to about 200 poises, uniform fibers may be readily spun therefrom. Pitches, on the other hand, which do not exhibit Newtonian or plastic flow behavior at the temperature of spinning, do not permit uniform fibers to be spun therefrom which can be converted by further heat treatment into fibers capable of developing the three-dimensional order characteristic of polycrystalline graphite.

Carbonaceous pitches having a mesophase content of from about 40 per cent by weight to about 90 per cent by weight can be produced in accordance with known techniques by heating a carbonaceous pitch in an inert atmosphere at a temperature above about 350° C. for a time sufficient to produce the desired quantity of mesophase. By an inert atmosphere is meant an atmosphere which does not react with the pitch under the heating conditions employed, such as nitrogen, argon, xenon, helium, and the like. The heating period required to produce the desired mesophase content varies with the particular pitch and temperature employed, with longer heating periods required at lower temperatures than at higher temperatures. At 350° C., the minimum temperature generally required to produce mesophase, at least one week of heating is usually necessary to produce a mesophase content of about 40 per cent. At temperatures of from about 400° C. to 450° C., conversion to mesophase proceeds more rapidly, and a 50 percent mesophase content can usually be produced at such temperatures within about 1–40 hours. Such temperatures are preferred for this reason. Temperatures above about 500° C. are undesirable, and heating at this temperature should not be employed for more than about 5 minutes to avoid conversion of the pitch to coke.

The degree to which the pitch has been converted to mesophase can readily be determined by polarized light microscopy and solubility examinations. Except for certain non-mesophase insolubles present in the original pitch or which, in some instances, develop on heating, the non-mesophase portion of the pitch is readily soluble in organic solvents such as quinoline and pyridine, while the mesophase portion is essentially insoluble.(3) In the case of pitches which do not develop non-mesophase insolubles when heated, the insoluble content of the heat treated pitch over and above the insoluble content of the pitch before it has been heat treated corresponds essentially to the mesophase content.(4) In the case of pitches which do develop non-mesophase insolubles when heated, the insoluble content of the heat treated pitch over and above the insoluble content of the pitch before it has been heat treated is not solely due to the conversion of the pitch to mesophase, but also represents non-mesophase insolubles which are produced along with the mesophase during the heat treatment. Pitches which contain infusible non-mesophase insolubles (either present in the original pitch or developed by heating) in amounts sufficient to prevent the development of homogeneous bulk mesophase are unsuitable for use in the present invention, as noted above. Generally, pitches which contain in excess of about 2 per cent by weight of such infusible materials are unsuitable. The presence or absence of such homogeneous bulk mesophase regions, as well as the presence or absence of infusible non-mesophase insolubles, can be visually observed by polarized light microscopy examination of the pitch (see, e.g., Brooks, J. D. and Taylor, G. H., supra, and Dubois J., Agache C. and White, J. L., supra). The amounts of each of these materials may also be visually estimated in this manner.

(3) The per cent of quinoline insolubles (Q.I.) of a given pitch is determined by quinoline extraction at 75° C. The per cent of pyridine insolubles (P.I.) is determined by Soxhlet extraction in boiling pyridine (115° C.).

(4) The insoluble content of the untreated pitch is generally less than 1 per cent (except for certain coal tar pitches) and consists largely of coke and carbon black found in the original pitch.

Aromatic base carbonaceous pitches having a carbon content of from about 92 per cent by weight to about 96 per cent by weight and a hydrogen content of from about 4 per cent by weight to about 8 per cent by weight are generally suitable for producing mesophase pitches which can be employed to produce the fibers of the instant invention. Elements other than carbon and hydrogen, such as oxygen, sulfur and nitrogen, are undesirable and should not be present in excess of about 4 per cent by weight. The presence of more than such amount of extraneous elements may disrupt the formation of carbon crystallites during subsequent heat treatment and prevent the development of a graphitic-like structure within the fibers produced from these materials. In addition, the presence of extraneous elements reduces the carbon content of the pitch and hence the ultimate yield of carbon fiber. When such extraneous elements are present in amounts of from about 0.5 per cent by weight to about 4 per cent by weight, the pitches generally have a carbon content of from about 92–95 per cent by weight, the balance being hydrogen.

Petroleum pitch, coal tar pitch and acenaphthylene pitch, which are well-graphitizing pitches, are preferred starting materials for producing the mesophase pitches which are employed to produce the fibers of the instant invention. Petroleum pitch, of course, is the residuum carbonaceous material obtained from the distillation of crude oils or the catalytic cracking of petroleum distillates. Coal tar pitch is similarly obtained by the distillation of coal. Both of these materials are commercially available natural pitches in which mesophase can easily be produced, and are preferred for this reason. Acenaphthylene pitch, on the other hand, is a synthetic pitch which is preferred because of its ability to produce excellent fibers. Acenaphthylene pitch can be produced by the pyrolysis of polymers of acenaphthylene as described by Edstrom et al. in U.S. Pat. No. 3,574,653.

Some pitches, such as fluoranthene pitch, polymerize very rapidly when heated and fail to develop large coalesced domains of mesophase, and are, therefore, not suitable precursor materials. Likewise, pitches having a high infusible non-mesophase insoluble content in organic solvents such as quinoline or pyridine, or those which develop a high infusible non-mesophase insoluble content when heated, should not be employed as starting materials, as explained above, because these pitches are incapable of developing the homogeneous bulk mesophase necessary to produce highly oriented carbonaceous fibers capable of developing the three-dimensional order characteristic of polycrystalline graphite. For this reason, pitches having an infusible quinoline-insoluble or pyridine-insoluble content of more than about 2 per cent by weight (determined as described above) should not be employed, or should be filtered to remove this material before being heated to produce mesophase. Preferably, such pitches are filtered when they contain more than about 1 percent by weight of such infusible, insoluble material. Most petroleum pitches and synthetic pitches have a low infusible, insoluble content and can be used directly without such filtration. Most coal tar pitches, on the other hand, have a high infusible, insoluble content and require filtration before they can be employed.

As the pitch is heated at a temperature between 350° C. and 500° C. to produce mesophase, the pitch will, of course, pyrolyze to a certain extent and the composition of the pitch will be altered, depending upon the temperature, the heating time, and the composition and structure of the starting material. Generally, however, after heating a carbonaceous pitch for a time sufficient to produce a mesophase content of from about 40 per cent by weight to about 90 per cent by weight, the resulting pitch will contain a carbon content of from about 94–96 per cent by weight and a hydrogen content of from about 4–6 per cent by weight. When such pitches contain elements other than carbon and hydrogen in amounts of from about 0.5 percent by weight to about 4 per cent by weight, the mesophase pitch will generally have a carbon content of from about 92–95 per cent by weight, the balance being hydrogen.

After the desired mesophase pitch has been prepared, it is spun into fibers by conventional techniques, e.g., by melt spinning, centrifugal spinning, blow spinning, or in any other known manner. As noted above, in order to obtain highly oriented carbonaceous fibers capable of developing the three-dimensional order characteristic of polycrystalline graphite the pitch must, under quiescent conditions, form a homogeneous bulk mesophase having large coalesced domains, and be nonthixotropic under the conditions employed in the spinning. Further, in order to obtain uniform fibers from such pitch, the pitch should be agitated immediately prior to spinning so as to effectively intermix the immiscible mesophase and non-mesophase portions of the pitch.

The temperature at which the pitch is spun depends, of course, upon the temperature at which the pitch exhibits a suitable viscosity. Since the softening temperature of the pitch, and its viscosity at a given temperature, increases as the mesophase content of the pitch increases, the mesophase content should not be permitted to rise to a point which raises the softening point of the pitch to excessive levels. For this reason, pitches having a mesophase content of more than about 90 per cent are generally not employed. Pitches containing a mesophase content of from about 40 per cent by weight to about 90 per cent by weight, however, generally exhibit a viscosity of from about 10 poises to about 200 poises at temperatures of from about 250° C. to about 450° C. and can be readily spun at such temperatures. At such viscosities, fibers may be conveniently spun from such pitches at a rate of from about 10 feet per minute to about 100 feet per minute and even up to about 3000 feet per minute. Preferably, the pitch employed has a mesophase content of from about 45 per cent by weight to about 65 per cent by weight, most preferably from about 55 per cent by weight to about 65 per cent by weight, and exhibits a viscosity of from about 30 poises to about 60 poises at temperatures of from about 340° C. to about 380° C. At such viscosity and temperature, uniform fibers having diameters of from about 10 microns to about 20 microns can be easily spun. As previously mentioned, however, in order to obtain the desired fibers, it is important that the pitch be nonthixotropic and exhibit Newtonian or plastic flow behavior during the spinning of the fibers.

The carbonaceous fibers produced in this manner are highly oriented graphitizable materials having a high degree of preferred orientation of their molecules parallel to the fibers axis. By graphitizable is meant that these fibers are capable of being converted thermally (usually by heating to a temperature in excess of about 2500° C., e.g., from about 2500° C. to about 3000° C.) to a structure having the three-dimensional order characteristic of polycrystalline graphite.

The fibers produced in this manner, of course, have the same chemical composition as the pitch from which they were drawn, and like such pitch contain from about 40 per cent by weight to about 90 per cent by weight mesophase. When examined under magnification by polarized light microscopy techniques, the fibers exhibit textural variations which give them the appearance of a "mini-composite". Large elongated anisotropic domains, having a fibrillar-shaped appearance, can be seen distributed throughout the fiber. These anisotropic domains are highly oriented and preferentially aligned parallel to the fiber axis. It is believed that these anisotropic domains, which are elongated by the shear forces exerted on the pitch during spinning of the fibers, are not composed entirely of mesophase, but are also made up of non-mesophase. Evidently, the non-mesophase is oriented, as well as drawn into elongated domains, during spinning by these shear forces and the orienting effects exerted by the mesophase domains as they are elongated. Isotropic regions may also be present, although they may not be visible and are difficult to differentiate from those anisotropic regions which happen to show extinction. Characteristically, the oriented elongated domains have diameters in excess of 5000 A, generally from about 10,000 A to about 40,000 A, and because of their large size are easily observed when examined by conventional polarized light microscopy techniques at a magnification of 1000. (The maximum resolving power of a standard polarized light microscope having a magnification factor of 1000 is only a few tenths of a micron [1 micron = 10,000 A] and anisotropic domains having dimensions of 1000 A or less cannot be detected by this technique.) On the other hand, fibers drawn from non-mesophase pitches do not contain any oriented anisotropic domains which can be observed when examined in this manner. Carbon fibers prepared from rayon and acrylic precursors, likewise, do not show the presence of oriented anisotropic domains when examined in this manner.

The X-ray diffraction pattern of the carbonaceous fibers produced from mesophase pitches according to the instant invention indicate that the fibers are characterized by a high degree of preferred orientation of the pitch molecules parallel to the fiber axis. This is apparent from the short arcs which constitute the (002) band of the diffraction pattern. Microdensitometer scanning of the (002) band of the exposed X-ray film indicate this preferred orientation to be generally from about 20° to about 35°, usually from about 25° to about 30° (expressed as the full width at half maximum of the azimuthal intensity distribution [FWHM]). Apparent stack height ($L_c$) of the aligned domains of pitch molecules, determined in like manner by microdensitometer scanning of the width of the (002) diffraction arc, is generally from about 25 A to about 60 A, usually from about 30 A to about 50 A. The interlayer spacing of the aligned domains $d$, calculated from the distance between the (002) diffraction arcs, is typically from about 3.40 A to about 3.55 A, usually from about 3.45 A to about 3.55 A. Such fibers are usually characterized by a density of from about 1.25 grams/cc. to about 1.40 grams/cc., most typically from about 1.30 grams/cc. to about 1.35 grams/cc.

Because of the thermoplastic nature of most of the carbonaceous fibers produced in accordance with the instant invention, it is usually necessary to thermoset these fibers before they can be carbonized. While fibers spun from a pitch containing in excess of about 85 per cent by weight mesophase often retain their shape when carbonized without any prior thermosetting, fibers spun from a pitch containing less than about 85 per cent by weight mesophase require some thermosetting before they can be carbonized.

Thermosetting of the fibers is readily effected by heating the fibers in an oxygen-containing atmosphere for a time sufficient to render them infusible. The oxygen-containing atmosphere employed may be pure oxygen or an oxygen-rich atmosphere. Most conveniently, air is employed as the oxidizing atmosphere.

The time required to effect thermosetting of the fibers will, of course, vary with such factors as the particular oxidizing atmosphere, the temperature employed, the diameter of the fibers, the particular pitch from which the fibers are prepared, and the mesophase content of such pitch. Generally, however, thermosetting of the fibers can be effected in relatively short periods of time, usually in from about 5 minutes to about 60 minutes.

The temperature employed to effect thermosetting of the fibers must, of course, not exceed the softening temperature of the fibers. The maximum temperature which can be employed will thus depend upon the particular pitch from which the fibers were spun, and the mesophase content of such pitch. The higher the mesophase content of the fiber, the higher will be its softening temperature, and the higher the temperature which can be employed to effect thermosetting. At higher temperatures, of course, fibers of a given diameter can be thermoset in less time than is possible at lower temperatures. Fibers having a lower mesophase content, on the other hand, require relatively longer heat treatment at somewhat lower temperatures to render them infusible.

A minimum temperature of at least 250° C. is generally necessary to effectively thermoset the carbonaceous fibers produced in accordance with the invention. Temperatures in excess of 400° C. may cause melting and/or excessive burn-off of the fibers and should be avoided. Preferably, temperatures of from about 300° C. to about 390° C. are employed. At such temperatures, thermosetting can generally be effected within from about 5 minutes to about 60 minutes. Since it is undesirable to oxidize the fibers more than necessary to render them totally infusible, the fibers are generally not heated for longer than about 60 minutes, or at temperatures in excess of 400° C.

After the fibers have been thermoset, the infusible fibers are carbonized by heating in an inert atmosphere, such as that described above, to a temperature sufficiently elevated to remove hydrogen and other volatiles and produce a substantially all-carbon fiber. Fibers having a carbon content greater than about 98 per cent by weight can generally be produced by heating to a temperature in excess of about 1000° C., and at temperatures in excess of about 1500° C., the fibers are completely carbonized. While the degree of preferred orientation of the original fiber is somewhat degraded as the fibers are heated to about 1000° C., on further heating, the degree of preferred orientation improves, and at about 1300° C. it is substantially the same as in the original fiber.

Usually, carbonization is effected at a temperature of from about 1000° C. to about 2000° C., preferably from about 1500° C. to 1700° C. Generally, residence times of from about 0.5 minute to about 25 minutes, preferably from about 1 minute to about 5 minutes, are employed. While more extended heating times can be employed with good results, such residence times are uneconomical and, as a practical matter, there is no advantage in employing such long periods.

In order to ensure that the rate of weight loss of the fibers does not become so excessive as to disrupt the fiber structure, it is preferred to heat the fibers for a brief period at a temperature of from about 700° C. to about 900° C. before they are heated to their final carbonization temperature. Residence times at these temperatures of from about 30 seconds to about 5 minutes are usually sufficient. Preferably, the fibers are heated at a temperature of about 700° C. for about one-half minute and then at a temperature of about 900° C. for like time. In any event, the heating rate must be controlled so that the volatilization does not proceed at an excessive rate.

In a preferred method of heat treatment, continuous filaments of the fibers are passed through a series of heating zones which are held at successively higher temperatures. If desired, the first of such zones may contain an oxidizing atmosphere where thermosetting of the fibers is effected. Several arrangements of apparatus can be utilized in providing the series of heating zones. Thus, one furnace can be used with the fibers being passed through the furnace several times and with the temperature being increased each time. Alternatively, the fibers may be given a single pass through several furnaces, with each successive furnace being maintained at a higher temperature than that of the previous furnace. Also, a single furnace with several heating zones maintained at successively higher temperatures in the direction of travel of the fibers, can be used.

The carbon fibers produced in this manner have a highly oriented structure characterized by the presence of carbon crystallites preferentially aligned parallel to the fiber axis, and are graphitizable materials which when heated to graphitizing temperatures develop the three-dimensional order characteristic of polycrystalline graphite and graphitic-like properties associated therewith, such as high density and low electrical resistivity. When examined under magnification by polarized light microscopy techniques, the fibers which have been oxidized prior to being carbonized exhibit a textural appearance similar to that of their as-drawn precursors. The large oriented elongated graphitizable domains present in the as-drawn fibers are also present in the carbonized fibers and, as in the as-drawn fibers, the domains are preferentially aligned parallel to the fiber axis. The fibers which have been carbonized without prior oxidation, on the other hand, no longer resemble the fine textured appearance of the as-drawn fibers, but are rather characterized by a much larger domain size. During the carbonization process, the mesophase domains present in the as-drawn, unoxidized fibers combine with each other and with the non-mesophase pitch present to produce very large oriented domains which, as in the as-drawn fibers, are preferentially aligned parallel to the fiber axis. In the fibers which have been oxidized prior to carbonization, however, the development of very large domains, such as are present in the fibers carbonized without oxidation, is inhibited by the oxidation which occurs when the fibers are heated in the presence of oxygen. As a result, the oriented domains of the fibers carbonized without prior oxidation are much larger than the oriented domains of the fibers carbonized after oxidation (actual width about 10,000 A to about 100,000 A vs. about 5,000 A to about 40,000 A).

The short arcs which constitute the (002) band of the X-ray diffraction pattern of carbon fibers produced according to the instant invention indicate that the fibers are characterized by a high degree of preferred orientation of their carbon crystallites parallel to the fiber axis. Microdensitometer scanning of the (002) band of the exposed X-ray film indicates the preferred orientation parameter (FWHM) of fibers heated to about 1000° C. to be less than about 45°, usually from about 30° to about 40°. Fibers heated to about 2000° C. have a higher degree of preferred orientation, i.e., a preferred orientation parameter (FWHM) of from about 10° to about 20°, usually from about 13° to about 17°. Further improvement in the degree of preferred orientation is obtained by heating the fibers at still higher temperatures. Thus, although the as-drawn fibers undergo some degradation in the degree of preferred orientation when heated to 1000° C., a much higher degree of preferred orientation is obtained on further heating to a temperature of about 2000° C. As stated previously, the degree of preferred orientation of fibers heated to about 1300° C. is substantially the same as in their as-drawn precursors, e.g., from about 20° to about 35°, usually from about 25° to about 30°.

Microdensitometer scanning of the width of the (002) diffraction arc of the X-ray diffraction pattern of fibers heated to about 1000° C. indicate the apparent stack height ($L_c$) of the carbon crystallites of the fibers to be generally from about 15 A to about 25 A, usually from about 18 A to about 22 A. For fibers heated to about 2000° C., the apparent stack height ($L_c$) is generally in excess of about 75 A, usually from about 80 A to about 100 A. Apparent stack height readily improves to significantly higher values when heating is conducted at still higher temperatures.

The interlayer spacing of the carbon crystallites of fibers heated to about 1500° C., calculated from the distance between the (002) diffraction arcs, is typically from about 3.40 A to about 3.43 A. These fibers have been found to be characterized by tensile strengths of greater than about $100 \times 10^3$ psi., e.g., from about $100 \times 10^3$ psi. to about $200 \times 10^3$ psi., and by a Young's modulus of elasticity greater than about $20 \times 10^6$ psi., e.g., from about $20 \times 10^6$ psi. to about $40 \times 10^6$ psi. Usually, the tensile strength of the fibers is from about $140 \times 10^3$ psi. to about $160 \times 10^3$ psi., and the Young's modulus is from about $25 \times 10^6$ psi. to about $35 \times 10^6$ psi.

The fibers heated to a temperature of about 1500° C. are quite dense, exhibiting a density in excess of 2.1 grams/cc., usually from about 2.1 grams/cc. to about 2.2 grams/cc. Electrical resistivity of such fibers is generally from about $800 \times 10^{-6}$ ohm centimeters to about $1200 \times 10^{-6}$ ohm centimeters.

If desired, the carbonized fibers may be further heated in an inert atmosphere, as described hereinbefore, to a still higher temperature in a range of from about 2500° C. to about 3300° C., preferably from about 2800° C. to about 3000° C., to produce fibers having not only a high degree of preferred orientation of their carbon crystallites parallel to the fiber axis, but also a structure characteristic of polycrystalline graphite. A residence time of about 1 minute is satisfactory, although both shorter and longer times may be employed, e.g., from about 10 seconds to about 5 minutes, or longer. Residence times longer than 5 minutes are uneconomical and unnecessary, but may be employed if desired.

The fibers produced by heating at a temperature above about 2500° C., preferably above about 2800° C. are characterized as having the three-dimensional order of polycrystalline graphite. This three-dimensional order is clearly established by the X-ray diffraction pattern of the fibers, specifically by the presence of the (112) cross-lattice line and the resolution of the (10) band into two distinct lines, (100) and (101). The short arcs which constitute the (00*l*) bands of the pattern shown the carbon crystallites of the fibers to be preferentially aligned parallel to the fiber axis. Microdensitometer scanning of the (002) band of the exposed X-ray film indicate this preferred orientation to be no more than about 10°, usually from about 5° to about 10° (expressed as the full width at half maximum of the azimuthal intensity distribution). Apparent layer size ($L_a$) and apparent stack height ($L_c$) of the crystallites are in excess of 1000 A and are thus too large to be measured by X-ray techniques.

The interlayer spacing *d* of the crystallites, calculated from the distance between the corresponding (001) diffraction arcs, is no more than 3.37 A, usually from 3.36 A to 3.37 A. The disorientation parameter *p* corresponding to an interlayer spacing of 3.37 A, as determined by the relationship of R. E. Franklin, supra, is about 0.4, while that corresponding to an interlayer spacing of 3.36 A is about 0.25.

When the fibers are examined under magnification by polarized light microscopy techniques, they exhibit an appearance similar to their precursor fibers, and like their precursors, are characterized by the presence of large oriented elongated domains (now graphitic rather than graphitizable) preferentially aligned parallel to the fiber axis. The width of these domains is ordinarily from about 5,000 A to about 40,000 A, except when the fibers are produced from fibers which have been carbonized and graphitized without prior oxidation, in which event the width of the domains is ordinarily from about 10,000 A to about 100,000 A.

In addition to having a structure characteristic of that of polycrystalline graphite, the fibers are characterized by graphitic-like properties associated with such structure, such as high density and low electrical resistivity. Typically, these fibers have a density in excess of 2.1 grams/cc. up to 2.2 grams/cc., and higher. Electrical resistivity of the fibers has been found to be less than $250 \times 10^{-6}$ ohm centimeters, usually from about $150 \times 10^{-6}$ ohm centimeters to about $200 \times 10^{-6}$ ohm centimeters.

The fibers are also characterized by high modulus and high tensile strengths. Thus, these fibers have been found to be characterized by tensile strengths in excess of about $200 \times 10^3$ psi. and by a Young's modulus of elasticity in excess of about $50 \times 10^6$ psi. Usually such fibers have a tensile strength in excess of about $250 \times 10^3$ psi., e.g., from about $250 \times 10^3$ psi. to about $350 \times 10^3$ psi., and a Young's modulus in excess of about $75 \times 10^6$ psi., e.g., from about $75 \times 10^6$ psi. to about $120 \times 10^6$ psi.

The instant invention thus provides a convenient method of preparing high strength, high modulus fibers in high yield from inexpensive, readily available, high carbon content precursors. The fibers can be used in the same applications where high strength, high modulus fibers have previously been employed, such as in the preparation of composites. The fibers are especially useful in applications where high electrical conductivity and thermal conductivity along the axis of the fibers is important, e.g., they can be used to produce graphitic cloth heating elements. Because of their extremely low electrical resistivity, the fibers can be employed as filler material in the production of graphite electrodes.

DESCRIPTION OF THE DRAWINGS

The unique structure of the fibers of the present invention is readily apparent from the attached X-ray diffraction patterns, and photomicrographs under polarized light.

The X-ray diffraction patterns were obtained on a bundle containing about 10 filaments of the sample mounted perpendicular to the X-ray beam. Copper $K\alpha$ radiation with a nickel filter was employed. Flat-plate or cylindrical film transmission pictures were taken, depending upon the temperature to which the fibers had been heated. Exposure times of between 5 and 16 hours were employed.

The photomicrographs were obtained on fibers encapsulated in an epoxy resin in a manner such that transverse or longitudinal sections could be examined. The samples were first fine ground on silicon carbide laps, then polished successively on diamond paste laps and finally with a microcloth saturated with a 0.3 per cent suspension of alumina in water. The samples were examined with a Bausch and Lomb metallograph under polarized light using cross polarizers.

Figure 1:
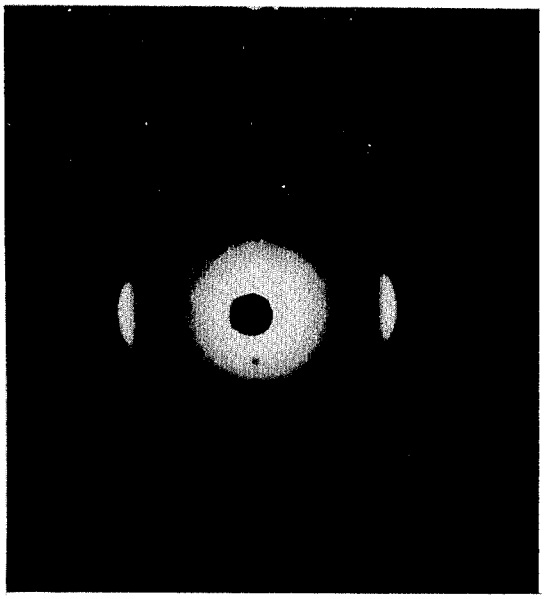

FIG. 1 is an X-ray diffraction pattern of pitch fibers spun from an acenaphthylene pitch at a temperature of 438° C., after the pitch had been heated at that temperature to produce a mesophase content of about 88 per cent. Despite the fact that the X-ray is of the fibers in their as-drawn condition, a high degree of preferred orientation of the pitch molecules parallel to the fiber axis is apparent from the short arcs which constitute the (002) band of the diffraction pattern. This preferred orientation was determined by microdensitometer scanning of the (002) band of the exposed X-ray film to be 26° (expressed as the full width at half maximum of the azimuthal intensity distribution [FWHM]). The apparent stack height, $L_c$, of the aligned domains of pitch molecules was determined in like manner by microdensitometer scanning of the width of the (002) diffraction arc and found to be 40 A.

Figure 2:
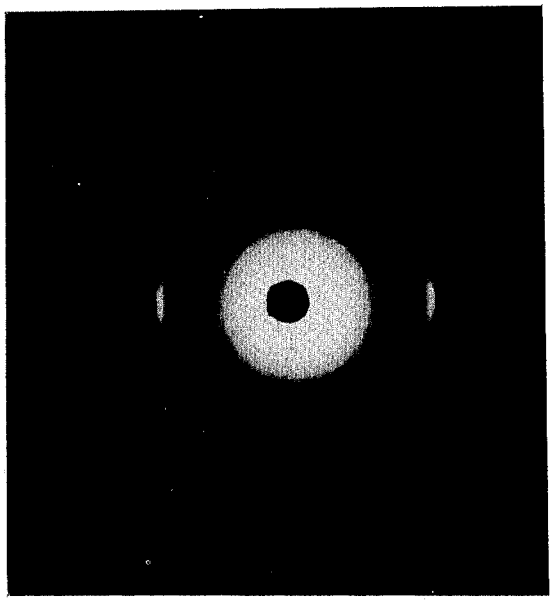

FIG. 2 is an X-ray diffraction pattern of pitch fibers spun from a commercial petroleum pitch at a temperature of 350° C., after the pitch had been heated for 10 hours at 400° C. to produce a mesophase content of about 50 per cent. Again despite the fact that the X-ray is of the fibers in their as-drawn condition, a high degree of preferred orientation of the pitch molecules parallel to the fiber axis exists, as is apparent from the short arcs which constitute the (002) band of the diffraction pattern. The degree of preferred orientation (FWHM) and apparent stack height, $L_c$, were determined as described above and found to be 29° and 47 A, respectively.

Figure 3:
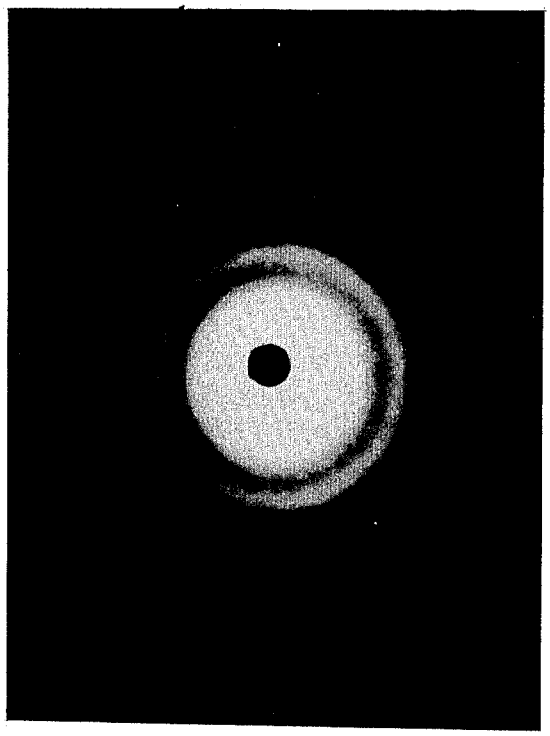

FIG. 3 is an X-ray diffraction pattern of pitch fibers spun from the same acenaphthylene pitch as the fibers whose X-ray diffraction pattern is depicted in FIG. 1 except that the pitch was heated immediately to a spinning temperature of 256° C.–258° C. without any prior heat treatment to produce mesophase. Again the X-ray pattern is of the fibers in their as-drawn condition. However, while the fibers whose X-ray diffraction pattern is depicted in FIG. 1 are characterized by a high degree of preferred orientation parallel to the fiber axis, no preferred orientation is evident in FIG. 3 (as indicated by the broad diffuse halo which constitutes the (002) band of the diffraction pattern).

Figure 4:
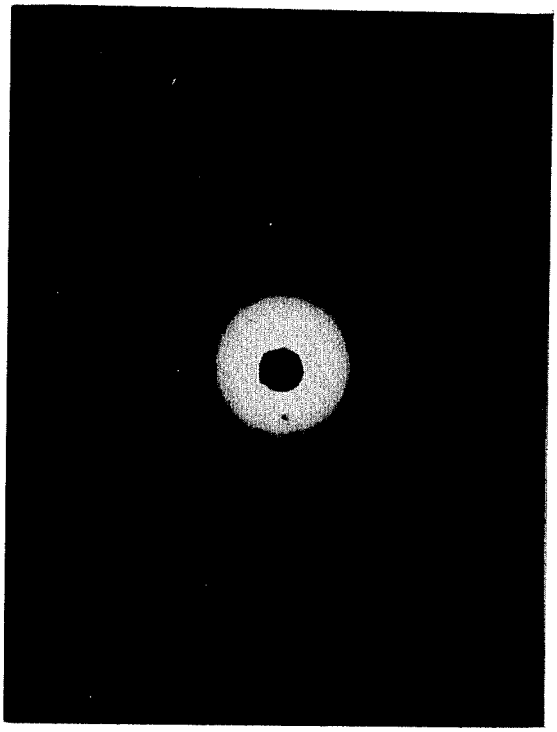

FIG. 4 is an X-ray diffraction pattern of pitch fibers spun from the same petroleum pitch as the fibers whose X-ray diffraction pattern is depicted in FIG. 2 except that the pitch was heated immediately to a spinning temperature of 158° C. without any prior heat treatment to produce mesophase. Again the X-ray pattern is of the fibers in their as-drawn condition. However, while the fibers whose X-ray diffraction pattern is depicted in FIG. 2 are characterized by a high degree of preferred orientation parallel to the fiber axis, no preferred orientation is evident in FIG. 4 (as indicated by the broad diffuse halo which constitutes the (002) band of the diffraction pattern).

FIG. 5 is an X-ray diffraction pattern of carbon fibers spun from the same acenaphthylene pitch and under the same conditions as the fibers whose X-ray diffraction pattern is depicted in FIG. 3, and then heated to 350° C. in oxygen at a rate of 10° C./minute and subsequently carbonized by heating to a temperature of 1000° C.[5] FIG. 6 is the X-ray diffraction pattern of the same carbon fibers whose X-ray is depicted in FIG. 5 after being further heated to 3000° C.[6] A comparison of FIGS. 5 and 6 to FIG. 3 clearly indicates that preferred orientation is not imparted to the as-drawn fibers by heating to higher temperatures.

(5) Carbonization was effected in an argon atmosphere over a period of about 1 hour.

(6) The fibers were heated to 3000° C. in an argon atmosphere over a period of about one hour and held at 3000° C. for 10 minutes.

FIG. 7 is an X-ray diffraction pattern of carbon fibers spun from the same petroleum pitch and under the same conditions as the fibers whose X-ray diffraction pattern is depicted in FIG. 4, and then heated to 350° C. in oxygen at a rate of 10° C./minute and subsequently carbonized by heating to a temperature of 1000° C.[5] FIG. 8 is an X-ray diffraction pattern of the same carbon fibers whose X-ray is depicted in FIG. 7 after being further heated to 3000° C.[6] A comparison of FIGS. 7 and 8 to FIG. 4 clearly indicates that preferred orientation is not imparted to the as-drawn fibers by heating to higher temperatures.

Figure 9:
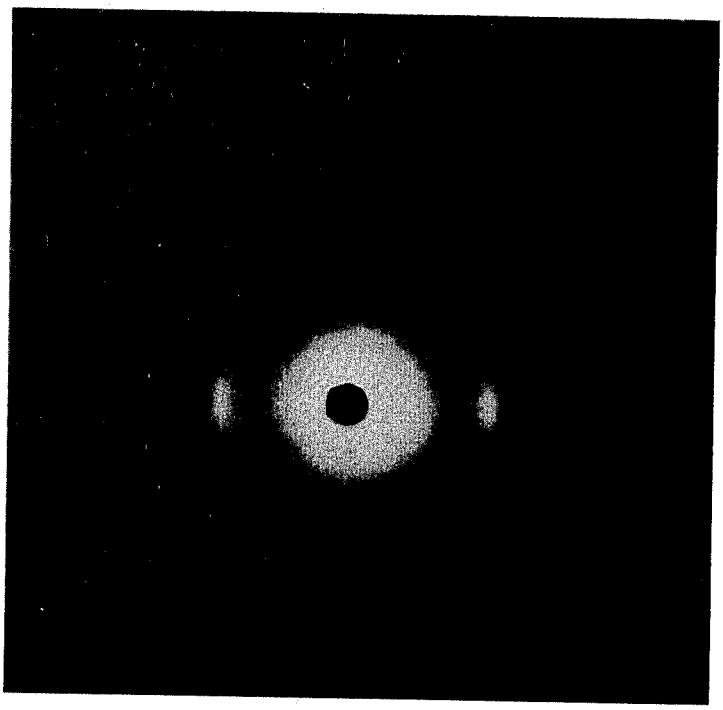
Figure 10:
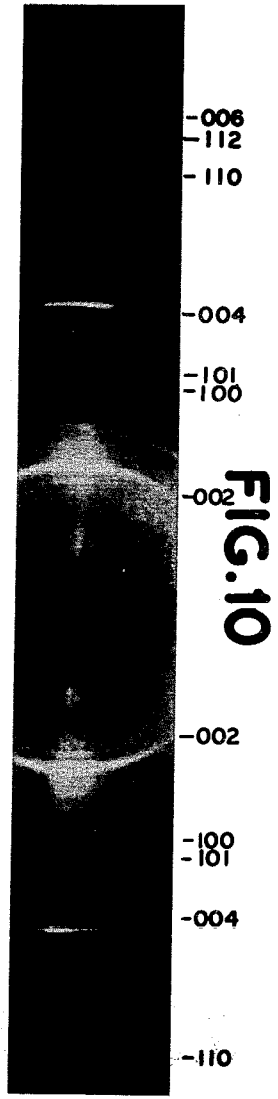

FIG. 9 is an X-ray diffraction pattern of carbon fibers spun from the same acenaphthylene pitch and under the same conditions as the fibers whose X-ray diffraction pattern is depicted in FIG. 1, and then heated to 350° C. in oxygen at a rate of 10° C./minute and subsequently carbonized by heating to a temperature of 1000° C.[5] FIG. 10 is the X-ray diffraction pattern of the same carbon fibers whose X-ray is depicted in FIG. 9 after being further heated to 3000° C.[6] A comparison of FIG. 10 to FIG. 1 shows that the preferred orientation of the as-drawn fibers is maintained after heating to 3000° C. Although a comparison of FIG. 9 to FIG. 1 indicates that some degradation of the preferred orientation of the as-drawn fibers occurs upon heating to 1000° C., a very high degree of preferred orientation is obtained upon further heating to 3000° C. (The degree of preferred orientation (FWHM) and apparent stack height, $L_c$, of the 1000° C. heat treated fibers were determined as described above in the discussion of FIG. 1 and found to be 33° and 19 A, respectively, as compared to 26° and 40 A, respectively, for the as-drawn fibers.) The degree of preferred orientation (FWHM) of the 3000° C. heat treated fibers was determined in like manner to be about 8°. Layer size, $L_a$, and stack height, $L_c$, were in excess of 1000 A and, therefore, too large to be measured by X-ray techniques.

The Miller indices for the various X-ray reflections are indicated in FIG. 10. The presence of the (112) cross-lattice line and the resolution of the (10) band into two distinct lines, (100) and (101), indicate a high degree of three-dimensional order characteristics of polycrystalline graphite. From the distance between the corresponding (001) lines the interlayer spacing $d$ was calculated and found to be 3.36 A. The disorientation parameter $p$ corresponding to this value was determined from the relationship of R. E. Franklin, supra., to be about 0.3.

Figure 13:
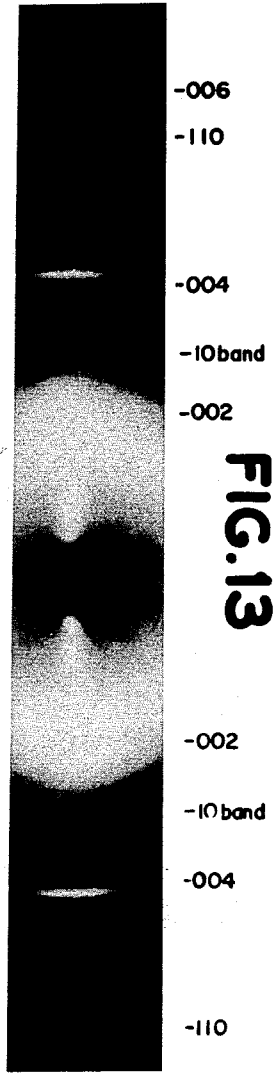
Figure 14:
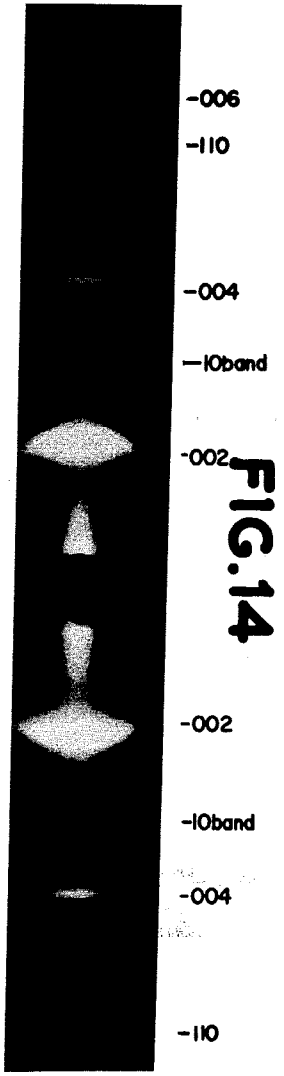

A comparison of FIG. 10 to FIGS. 13 and 14 indicates the graphitic nature of these fibers compared to the turbostratic structure of the fibers produced by heating fibers composed of polyacrylonitrile or rayon to 3000° C. Thus, contrary to the fibers whose X-ray diffraction pattern is depicted in FIG. 10, the X-ray diffraction pattern of the fibers produced by heating fibers composed of polyacrylonitrile or rayon to 3000° C., depicted in FIGS. 13 and 14, do not show any of the lines characteristic of three-dimensional order, e.g., the (112) cross-lattice line is absent and there has been no resolution of the (10) band. In addition, the interlayer spacing *d* and disorientation parameter *p* of such fibers far exceed the interlayer spacing *d* and disorientation parameter *p* of the fibers whose X-ray diffraction pattern is depicted in FIG. 10, while the apparent crystallite size of these fibers is considerably less than the fibers whose X-ray diffraction pattern is depicted in FIG. 10 (see discussion of FIGS. 13 and 14 below). The values of these parameters further demonstrate the graphitic nature of the fibers whose X-ray diffraction pattern is depicted in FIG. 10 compared to the fibers whose X-ray diffraction pattern is depicted in FIGS. 13 and 14.

FIG. 11 is an X-ray diffraction pattern of carbon fibers spun from the same petroleum pitch and under the same conditions as the fibers whose X-ray diffraction pattern is depicted in FIG. 2, and then heated to 350° C. in oxygen at a rate of 10° C./minute and subsequently carbonized by heating to a temperature of 1000° C.[5] FIG. 12 is the X-ray diffraction pattern of the same carbon fibers whose X-ray is depicted in FIG. 11 after being further heated to 3000° C.[6] A comparison of FIG. 12 to FIG. 2 shows that the preferred orientation of the as-drawn fibers is maintained after heating to 3000° C. Although a comparison of FIG. 11 to FIG. 2 indicates that some degradation of the preferred orientation of the as-drawn fibers occurs upon heating to 1000° C., a very high degree of preferred orientation is obtained upon further heating to 3000° C. (The degree of preferred orientation (FWHM) and apparent stack height, $L_c$, of the 1000° C. heat treated fibers were determined as described above in the discussion of FIG. 1, and found to be 40° and 21 A, respectively, as compared to 20° and 47 A, respectively, for the as-drawn fibers.) The degree of preferred orientation (FWHM) of the 3000° C. heat treated fibers was determined in like manner to be about 8°. Layer size, $L_a$, and stack height, $L_c$, were in excess of 1000 A and, therefore, too large to be measured by X-ray techniques.

As is evident from the presence of the (112) cross-lattice line and the resolution of the (10) band into two distinct lines, (100) and (101), the fibers whose X-ray diffraction pattern is depicted in FIG. 12, like the fibers whose X-ray diffraction pattern is depicted in FIG. 10, are characterized by a high degree of three-dimensional order characteristic of polycrystalline graphite as opposed to the turbostratic structure of the fibers whose X-ray diffraction patterns are depicted in FIGS. 13 and 14 (produced by heating fibers composed of polyacrylonitrile and rayon, respectively, to 3000° C.) The graphitic nature of these fibers compared to the fibers whose X-ray diffraction patterns are depicted in FIGS. 13 and 14 is further demonstrated by their interlayer spacing *d* and disorientation parameter *p* which are considerably less than the interlayer spacing *d* and disorientation parameter *p* of the fibers whose X-ray diffraction patterns are depicted in FIGS. 13 and 14, and by their crystallite size which is considerably greater than the crystallite size of the fibers whose X-ray diffraction patterns are depicted in FIGS. 13 and 14 (see discussion of FIGS. 13 and 14 below). The interlayer spacing *d* was calculated from the distance between the corresponding (001) lines and found to be 3.37 A. The disorientation parameter *p* corresponding to this value was determined from the relationship of R. E. Franklin, supra, to be about 0.4.

FIG. 13 is an X-ray diffraction pattern of carbon fibers produced from polyacrylonitrile fibers by first oxidizing the fibers under stress in air for about 12 hours at a temperature of 200°–250° C., then carbonizing the fibers to a temperature of 1000° C. and finally heating the carbonized fibers to 3000° C.[6] Although a high degree of preferred orientation parallel to the fiber axis is apparent from the short arcs which constitute the (001) bands of the pattern, the absence of the (112) cross-lattice line and the lack of resolution of the (10) band are indicative of the absence of three-dimensional order. From the distance between the corresponding (001) lines the interlayer spacing (d) was calculated and found to be 3.41 A. The disorientation parameter (p) corresponding to this value was determined from the relationship of R. E. Franklin, supra, to be about 0.8. A fairly small stack height, $L_c$, was indicated by the width of the (002) arc. Apparent layer size, $L_a$, and apparent stack height, $L_c$, of similarly processed polyacrylonitrile fibers were determined by A. Shindo to be 200 A and 90 A, respectively (Shindo A., "Studies on Graphite Fiber", Report No. 317 of the Governmental Industrial Research Institute, Osaka, Japan, December, 1961).

FIG. 14 is an X-ray diffraction pattern of carbon fibers produced from rayon fibers by first heating the fibers in air for a few minutes at a temperature of 260°–280° C., then carbonizing the fibers to a temperature of 1000° C.[7] and finally heating the carbonized fibers under stress to 3000° C.[8] Although a high degree of preferred orientation parallel to the fiber axis is apparent from the short arcs which constitute the (00*l*) bands of the pattern, the absence of the (112) cross-latice line and the lack of resolution of the (10) band are indicative of the absence of three-dimensional order. From the distance between the corresponding (00*l*) lines the interlayer spacing *d* was calculated and found to be 3.41 A. The disorientation parameter *p* corresponding to this value was determined from the relationship of R. E. Franklin, supra, to be about 0.8. A fairly small stack height, $L_c$, was indicated by the width of the (002) arc. Apparent layer size, $L_a$, and apparent stack height, $L_c$, of similarly processed rayon fibers were determined by Ruland et al. to be about 100 A each (perret, R. and Ruland, W., J. Appl. Cryst., 3, 525, 1970; Fourdeux, A., Perret, R. and Ruland W., Conference on Carbon Fibers, Their Composites, and Applications, The Plastics Institute, London, 2–4 Feb., 1971, Paper No. 9).

(7) Carbonization was effected in a nitrogen atomosphere in less than one minute.

(8) The fibers were heated to 3000° C. under stress in a nitrogen atmosphere in less than one minute, and later reheated at 3000° C. in an argon atmosphere for ten minutes in the absence of stress.

Figure 15:
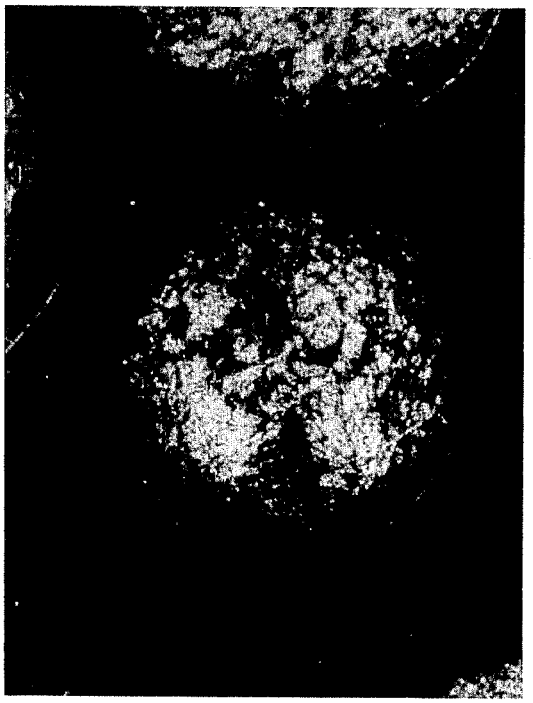
Figure 16:
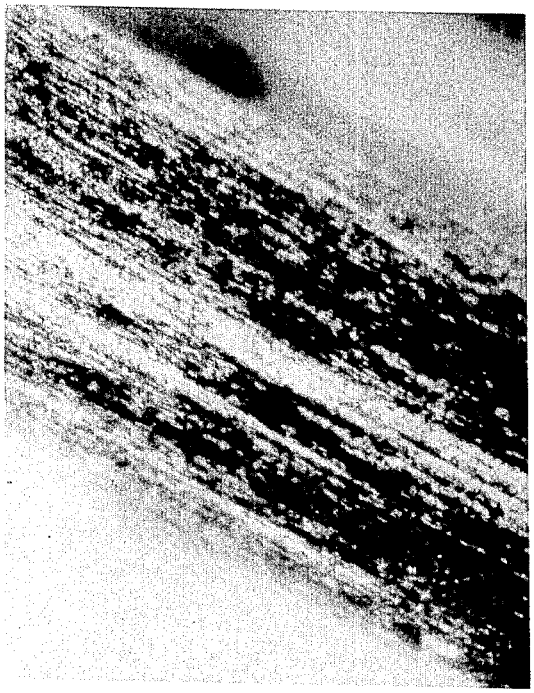

FIG. 15 is a photomicrograph under polarized light of cross sections of pitch fibers spun from a commercial petroleum pitch at a temperature of 350° C., after the pitch had been heated for 10 hours at 400° C. to produce a mesophase content of about 50 per cent. FIG. 16 is a photomicrograph under polarized light of a longitudinal section of like fiber. The photomicrographs have a magnification factor of 500X and show the fibers in their as-drawn condition. The textural variations visible in the photomicrographs give the fibers the appearance of a mini-composite. Large oriented domains can be seen distributed throughout the fiber, and, as is evident from the longitudinal view in FIG. 16, these oriented domains are fibrillar-shaped in appearance and preferentially aligned parallel to the fiber axis. The width of the domains under magnification is about 0.5–2 millimeters, indicating that they have an actual width of from about 1–4 microns.

Figure 17:
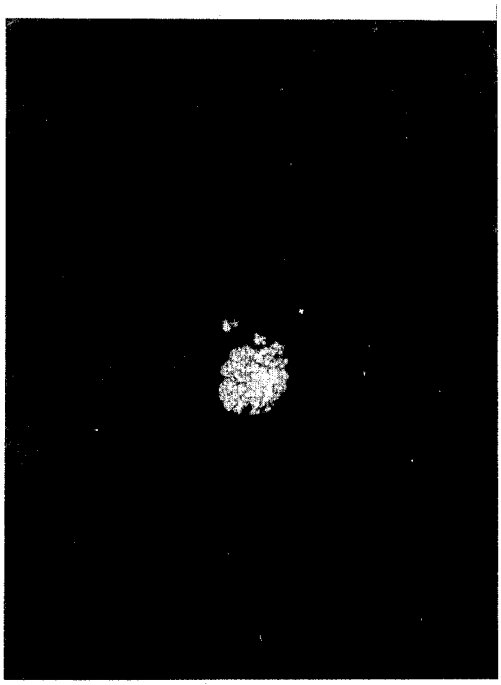
Figure 18:
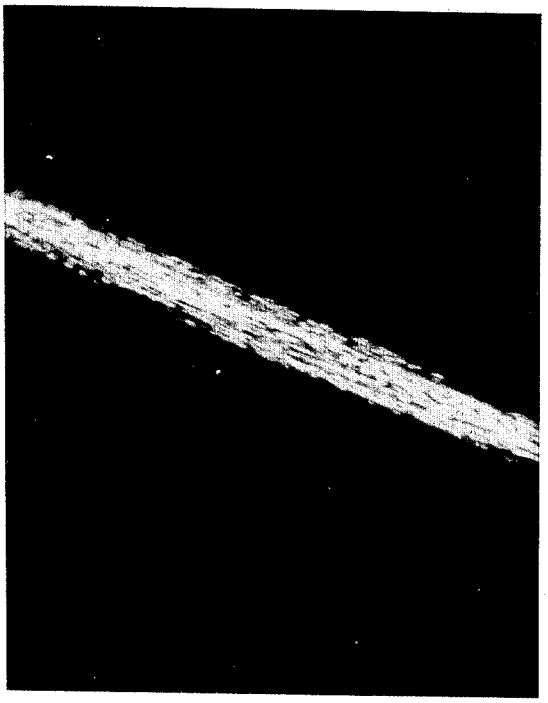
Figure 19:
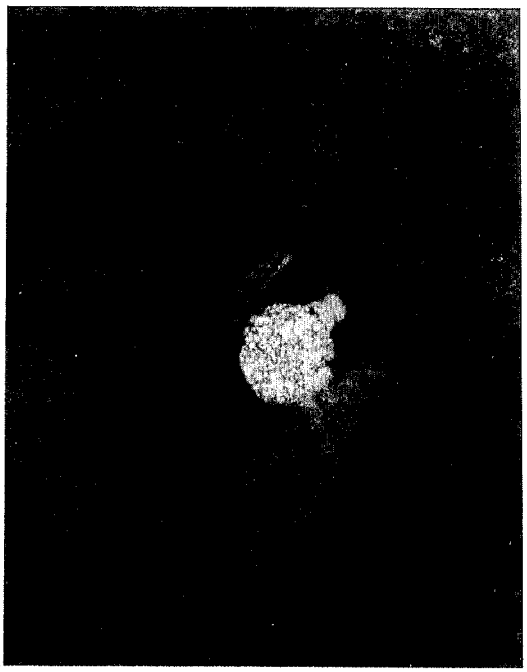
Figure 20:
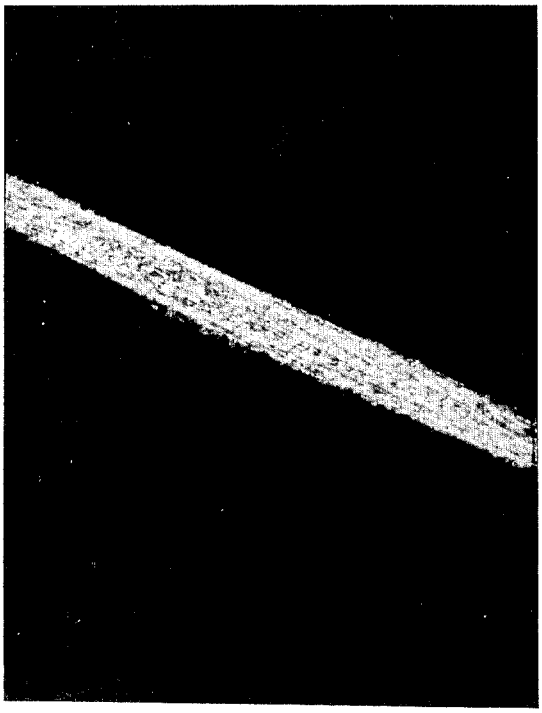

FIG. 17 is a photomicrograph under polarized light of the cross section of a carbon fiber spun from the same petroleum pitch and under the same conditions as the fibers whose photomicrographs are depicted in FIGS. 15 and 16, and then heated to 350° C. in oxygen at a rate of 10° C./minute and subsequently carbonized by heating to a temperature of 1675° C.[5] FIG. 18 is a longitudinal view of like fiber. FIGS. 19 and 20 are photomicrographs under polarized light of the cross section and longitudinal section, respectively, of carbon fibers produced in a similar manner except that the fibers were heated to a temperature of 3000° C.[6] The photomicrographs have a magnification factor of 1000X. The fibers shown therein exhibit the same preferred orientation and fibrillar appearance as the as-drawn fibers whose photomicrographs are depicted in FIGS. 15 and 16. The width of the fibrillar-shaped domains under magnification for both the 1675° C. and 3000° C. heat-treated fibers is about 1–4 millimeters, indicating that they have an actual width of from about 1–4 microns.

Figure 21:
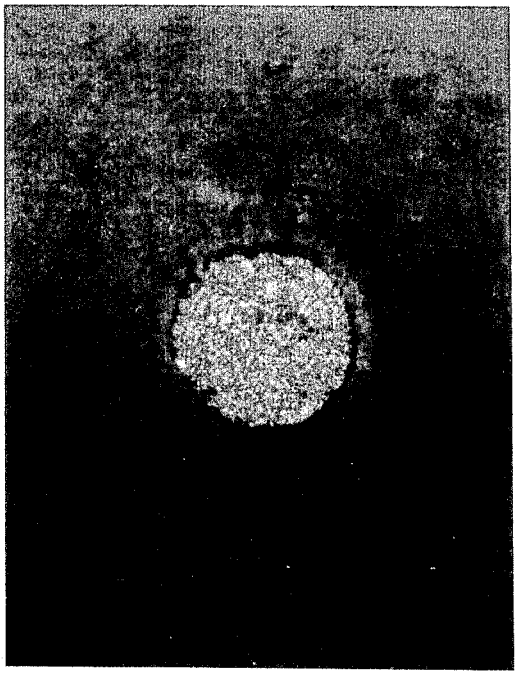

FIG. 21 is a photomicrograph under polarized light of the cross section of a pitch fiber spun from an acenaphthylene pitch at a temperature of 438° C., after the pitch had been heated at that temperature to produce a mesophase content of about 88 per cent. The photomicrograph has a magnification factor of 1000X and shows the fiber in its as-drawn condition. The textural variations visible in the photomicrograph give the fiber the appearance of a minicomposite. Large oriented domains can be seen distributed throughout the fiber. These oriented domains have a width of about 0.5–2 millimeters under magnification, indicating that they have an actual width of from about 0.5 to 2 microns.

FIG. 22 is a photomicrograph under polarized light of the cross section of a carbon fiber spun from the same acenaphthylene pitch and under the same conditions as the fibers whose photomicrograph is depicted in FIG. 21, and then heated to 350° C. in oxygen at a rate of 10° C./minute and subsequently carbonized by heating to a temperature of 1605° C[5] FIG. 23 is a photomicrograph under polarized light of the cross section of a carbon fiber produced in a similar manner except that the fiber was carbonized without prior heat-treatment in oxygen.[9] The photomicrographs have a magnification factor of 1000X. While the fiber carbonized after oxidation (FIG. 22) exhibits a similar textural appearance to the as-drawn fiber whose photomicrograph is depicted in FIG. 21, the fiber carbonized without prior oxidation (FIG. 23) is characterized by a much larger domain structure and no longer resembles the fine-textured composite appearance of the as-drawn fiber. During heating to a carbonizing temperature, the mesophase domains present in the as-drawn, unoxidized fiber combine with each other and with the non-mesophase pitch present to produce the large oriented carbon domains visible in the photomicrograph. In the case of the oxidized fiber, however, the oxidation which occurs when the fiber is heated in oxygen inhibits the development of the very large domains present in the fibers carbonized without oxidation. As a result, the widths of the oriented domains of the unoxidized fiber are much larger than the widths of the oriented domains of the oxidized fiber (about 1 up to about 10 millimeters under magnification or from about 1–10 microns actual vs. about 1–4 millimeters under magnification or from about 1–4 microns actual).

(9) Carbonization was effected by heating to 1600° C. in an argon atmosphere over a period of about 1 hour.

Figure 24:
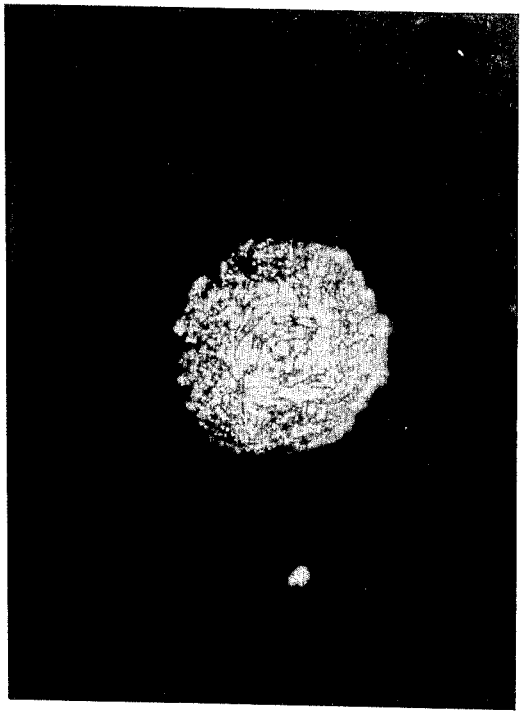

FIG. 24 is a photomicrograph under polarized light of the cross section of a carbon fiber spun from the same acenaphthylene pitch and under the same conditions as the fiber whose photomicrograph is depicted in FIG. 21, and then heated to 350° C. in oxygen at a rate of 10° C./minute and subsequently heated to a temperature of 3000° C.[10]

(10) The fibers were heated in an argon atmosphere to a temperature of 800° C. over a period of about one hour and then heated from 800° C. to 3000° C. over a period of about 1 hour.

Figure 25:
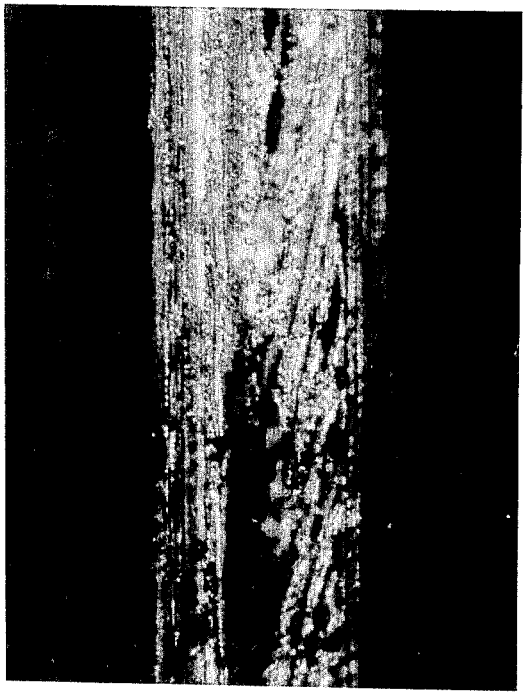

FIG. 25 is a photomicrograph under polarized light of a longitudinal section of like fiber. The photomicrographs have a magnification factor of 1000X. The fibers shown therein exhibit a similar textural appearance to the as-drawn fiber whose photomicrograph is depicted in FIG. 21 and the 1605° C. heat-treated fiber whose photomicrograph is depicted in FIG. 22. As in the 1605° C. heat-treated fiber, the development of very large domains is inhibited by the oxidation which occurs when the fibers are heated in oxygen. Comparison of FIGS. 24 and 25 to FIGS. 19 and 20, however, show the oriented domains of the fibers to be generally larger and coarser than the oriented domains of fibers prepared in a similar manner from petroleum pitch containing a mesophase content of about 50 per cent. (The width of the oriented domains under magnification is about 1–4 millimeters, indicating that these domains have an actual width from about 1–4 microns). The larger, coarser structure is believed to be due to a lesser oxidation of these fibers during heat treatment in oxygen compared to the petroleum pitch fibers, allowing the development of generally larger domains upon subsequent heat treatment at high temperatures than occurs in the more oxidized fibers. The concentration of the larger more coarse domains near the center of the fibers where oxygen cannot penetrate as effectively demonstrates that the growth of these domains is greatest where oxidation is least. Generally, the extent to which the fibers are oxidized will depend upon such factors as the diameter of the fibers, the particular oxidizing atmosphere, the time and temperature of oxidation, the particular pitch from which the fibers are prepared, and the mesophase content of such pitch.

Figure 26:
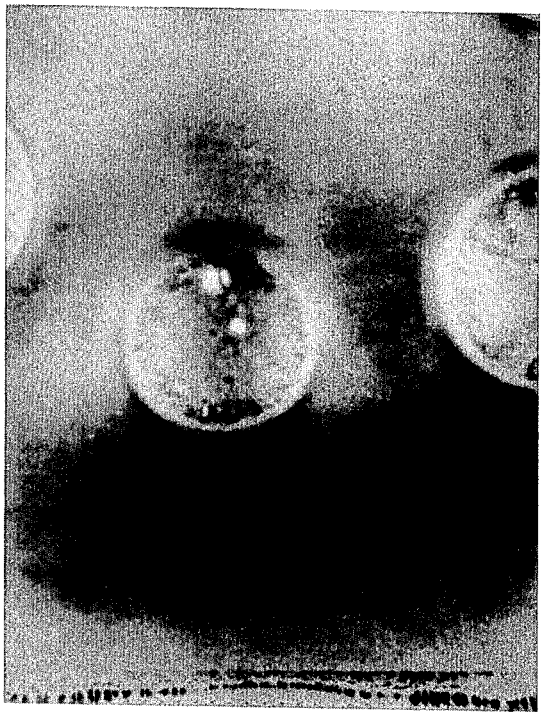
Figure 27:
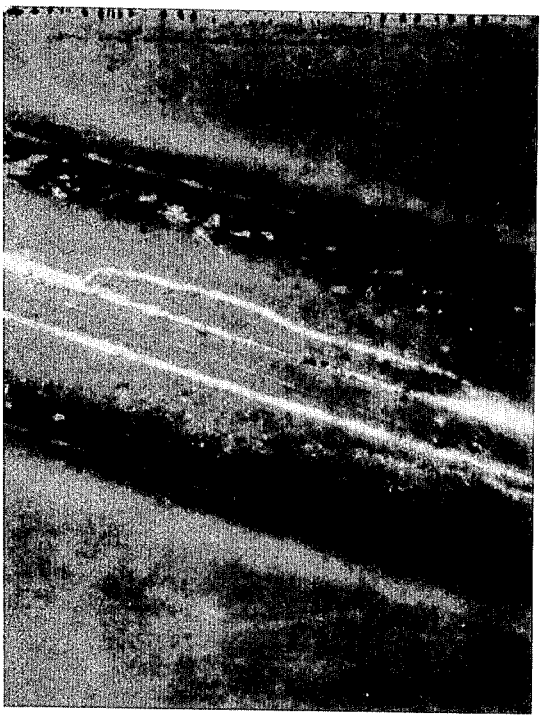

FIG. 26 is a photomicrograph under polarized light of cross sections of pitch fibers spun from the same petroleum pitch as the fibers whose photomicrographs are depicted in FIGS. 15 and 16 except that the pitch was heated immediately to a spinning temperature of 158° C. without any prior heat treatment to produce mesophase. FIG. 27 is a photomicrograph under polarized light of a longitudinal section of like fiber. The photomicrographs have a magnification factor of 1000X and show the fibers in their as-drawn condition. The fibers shown therein appear to be essentially homogeneous and do not exhibit the textural variations and mini-composite appearance of the as-drawn fibers whose photomicrographs are depicted in FIGS. 15, 16 and 21. The white spots and lines present in the photomicrographs are not due to the presence of anisotropic domains but are caused by the penetration of polishing compound into fiber voids and cracks during sample preparation.

Figure 28:
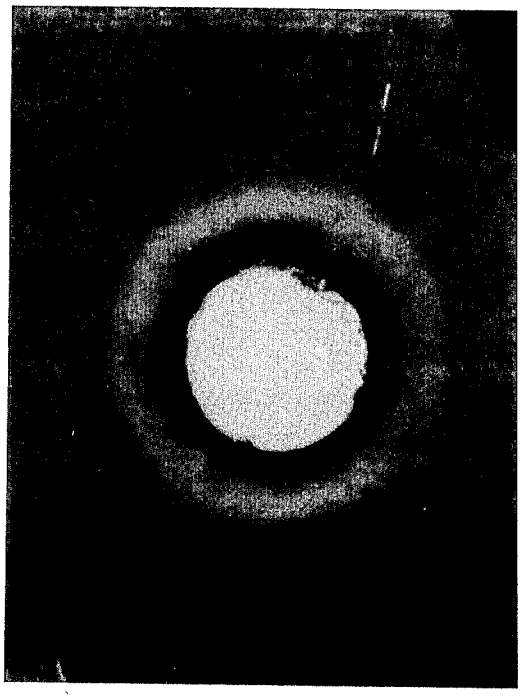
Figure 29:
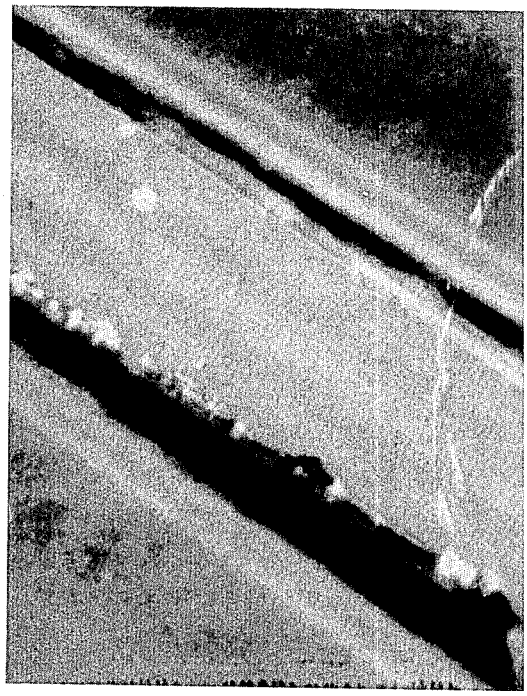
Figure 30:
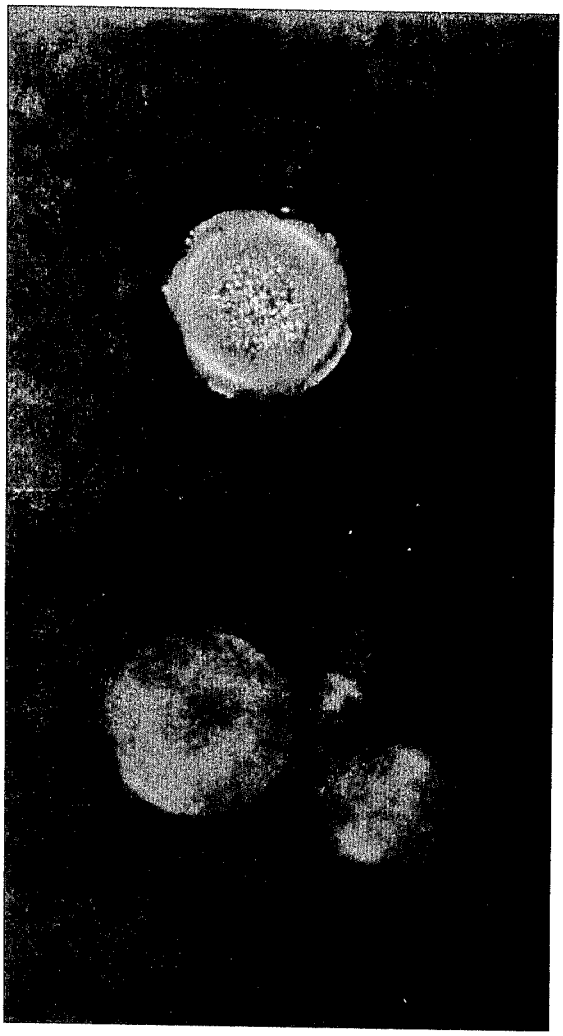
Figure 31:
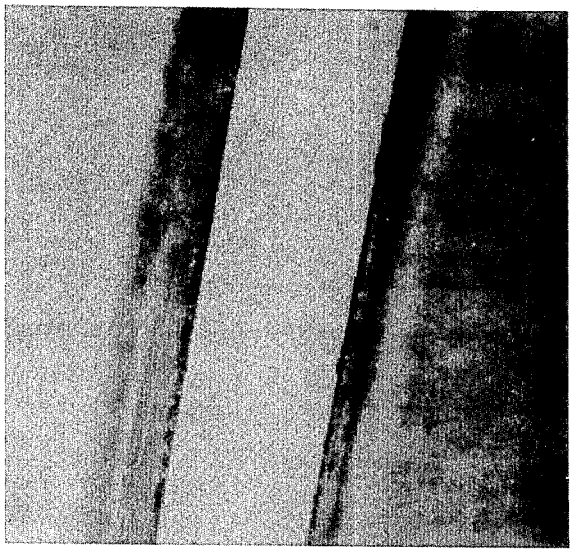

FIG. 28 is a photomicrograph under polarized light of the cross section of a carbon fiber spun from the same petroleum pitch and under the same conditions as the fibers whose photomicrographs are depicted in FIGS. 26 and 27, and then heated to 340° C. in oxygen at a rate of 10° C./minute and subsequently carbonized by heating to a temperature of 1600° C.[11] FIG. 29 is a longitudinal view of like fiber. FIGS. 30 and 31 are photomicrographs under polarized light of the cross sections and longitudinal section, respectively, of carbon fibers produced in a similar manner except that the fibers were heated to a temperature of 3000° C.[6] The photomicrographs each have a magnification factor of 1000X. The fibers heat treated to 1600° C. (FIGS. 28 and 29), like the as-drawn fibers whose photomicrographs are depicted in FIGS. 26 and 27, appear to be essentially homogeneous and do not exhibit the textural variations and fibrillar appearance of the fibers whose photomicrographs are depicted in FIGS. 15–22 and 24–25. (As in FIGS. 26 and 27, the white spots present in the photomicrographs are caused by the penetration of polishing compound into sample voids during preparation of the samples). It is evident from a comparison of FIGS. 28 and 29 to FIGS. 26 and 27 that preferred orientation is not imparted to the as-drawn fibers by heating to higher temperatures. On the other hand, one of the fibers whose photomicrographs are depicted in FIG. 30 (heat treated to 3000° C.) does appear to have developed some randomly oriented crystalline grain structure near the core of the fiber (the other fibers depicted in FIGS. 30 and 31 are substantially homogeneous) despite the fact that it was produced from petroleum pitch which had not been heat-treated to produce mesophase. This unusual phenomenon is attributed to incomplete oxidation of the fiber core during heat treatment of the fiber in oxygen, allowing some development of randomly oriented granular crystalline domains in the unoxidized central portion of the fiber during subsequent heat treatment at higher temperatures. Under such conditions, some of the non-mesophase pitch present in the unoxidized central portion of the fiber may be converted to mesophase during carbonization between 400° C. and 500° C., so that the resulting fiber contains small crystalline domains (less than about 1 micron) near the core but is unconverted throughout the remainder of the fiber. However, the domains are randomly oriented and granular rather than elongated, and there is no preferential alignment of oriented domains parallel to the fiber axis in such fibers. As a result, the fibers do not possess the high degree of crystallite orientation along the fiber axis ordinarily associated with high fiber modulus.

(11) Carbonization was effected in an argon atmosphere over a period of about one hour and held at 1600° C. for 10 minutes.

Figure 32:
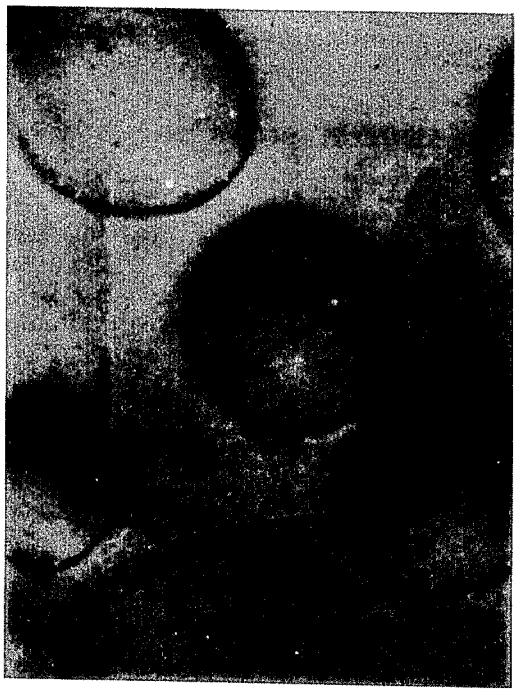

FIG. 32 is a photomicrograph under polarized light of cross-sections of pitch fibers spun from the same acenaphthylene pitch as the fiber whose photomicrograph is depicted in FIG. 21 except that the pitch was heated immediately to a spinning temperature of 256° C.–258° C. without any prior heat treatment to produce mesophase. The photomicrograph has a magnification factor of 1000X and shows the fibers in their as-drawn condition. The fibers shown therein appear to be essentially homogeneous and do not exhibit the textural variations and mini-composite appearance of the as-drawn fibers whose photomicrographs are depicted in FIGS. 15, 16 and 21. (The white spots present in the photomicrograph are not due to the presence of anisotropic domains but are caused by the penetration of polishing compound into fiber voids during preparation of the sample.)

Figure 33:
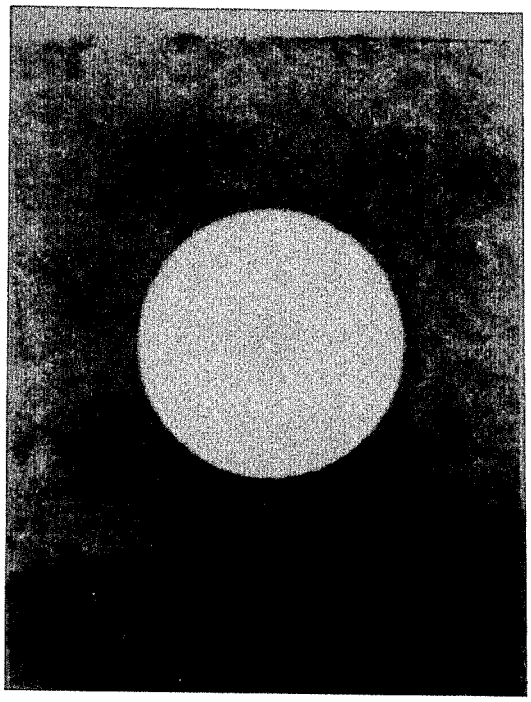
Figure 34:
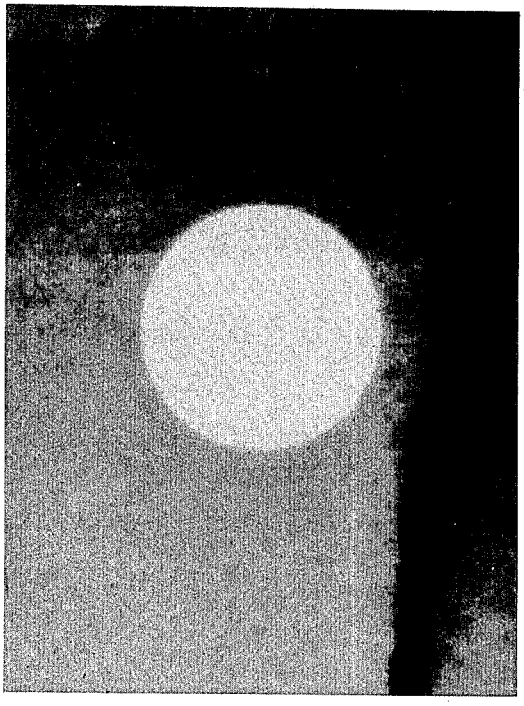
Figure 35:
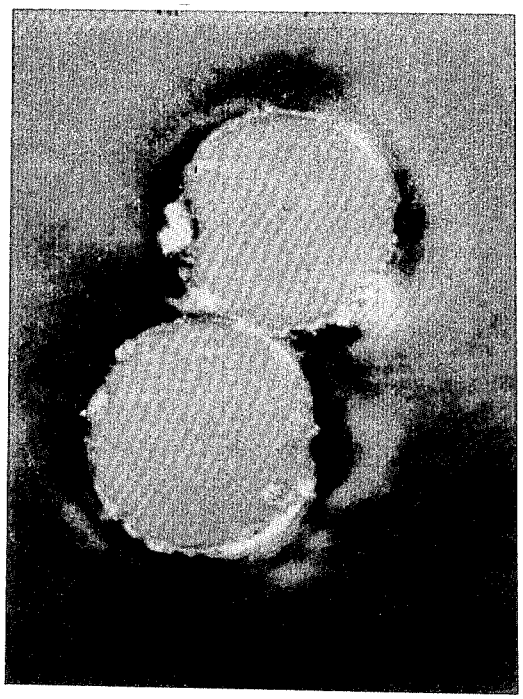
Figure 36:
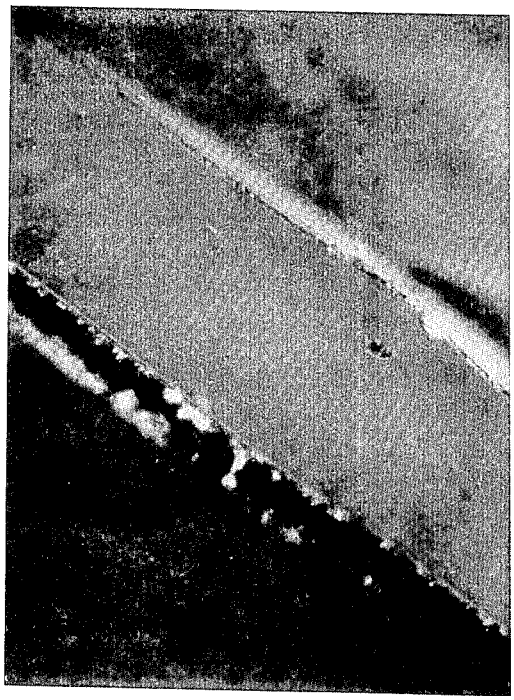

FIG. 33 is a photomicrograph under polarized light of the cross section of a carbon fiber spun from the same acenaphthylene pitch and under the same conditions as the fibers whose photomicrographs are depicted in FIG. 32, and then heated to 315° C. in oxygen at a rate of 10° C./minute and subsequently carbonized by heating to a temperature of 1505° C.[12] FIG. 34 is a photomicrograph under polarized light of the cross-section of a carbon fiber produced in a similar manner except that the fiber was heated to a temperature of 2000° C.[13] FIG. 35 is a photomicrograph under polarized light of cross-sections of carbon fibers also produced in a similar manner except that the fibers were oxidized to 350° C. and further heated to a temperature of 3000° C.[6] FIG. 36 is a longitudinal view of like 3000° C. heat-treated fiber. The photomicrographs each have a magnification factor of 1000X. The fibers shown therein, like the as-drawn fibers whose photomicrographs are depicted in FIG. 32, appear to be essentially homogeneous and do not exhibit the textural variations and fibrillar appearance of the fibers whose photomicrographs are depicted in FIGS. 15–22 and 24–25. (As in FIG. 32, the white spots present in the photomicrographs are caused by the penetration of polishing compound into sample voids during preparation of the samples). It is evident from a comparison of FIGS. 33 to 36 to FIG. 32 that such structure is not imparted to the as-drawn fibers by heating to higher temperatures.

(12) Carbonization was effected in an argon atmosphere over a period of about 1 hour and held at 1505° C. for 10 minutes.

(13) The fibers were heated to 2000° C. in an argon atmosphere over a period of about 1 hour and held at 2000° C. for 10 minutes.

Figure 37:
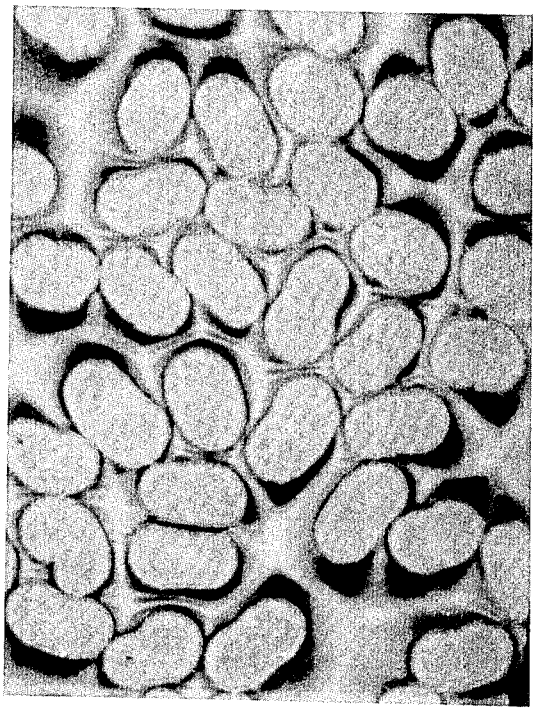
Figure 38:
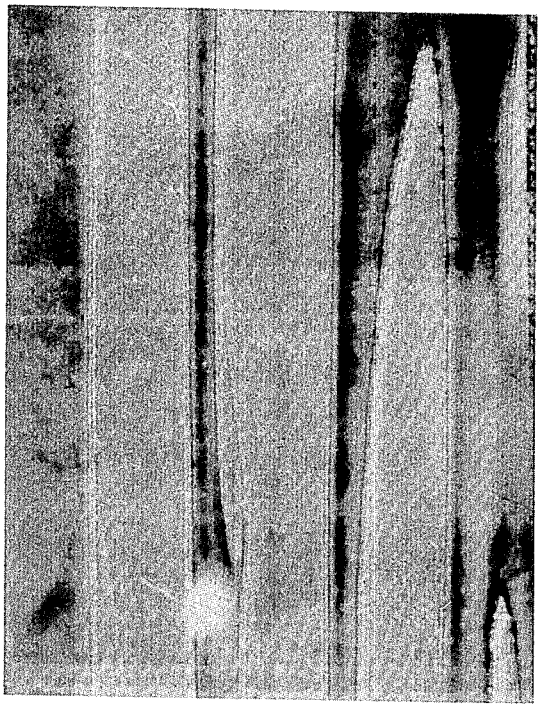

FIG. 37 is a photomicrograph under polarized light of cross-sections of fibers produced from polyacrylonitrile fibers by first oxidizing the fibers under stress in air for about 12 hours at a temperature of 200°–250° C., and then heating to a temperature of 400° C. FIG. 38 is a photomicrograph under polarized light of longitudinal sections of like fibers. The photomicrographs have a magnification factor of 1000X. The fibers appear to be essentially homogeneous and do not exhibit the textural variations and fibrillar appearance of the fibers whose photomicrographs are depicted in FIGS. 15–22 and 24–25. (The white spots present in the photomicrographs are caused by the penetration of polishing compound into sample voids during the preparation of the samples.)

Figure 39:
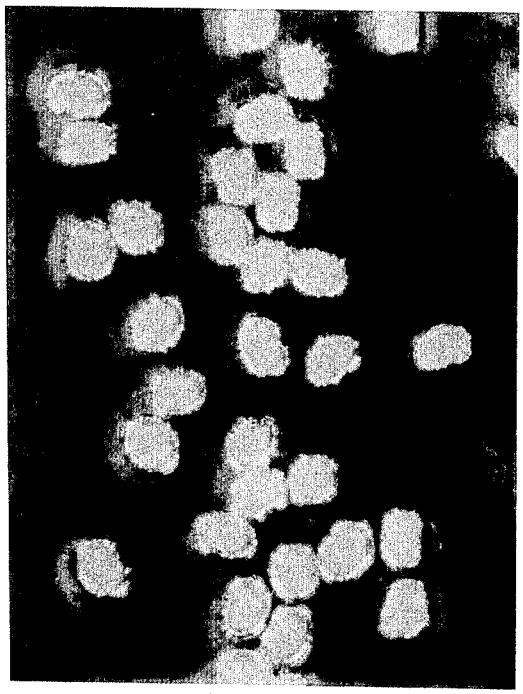
Figure 40:
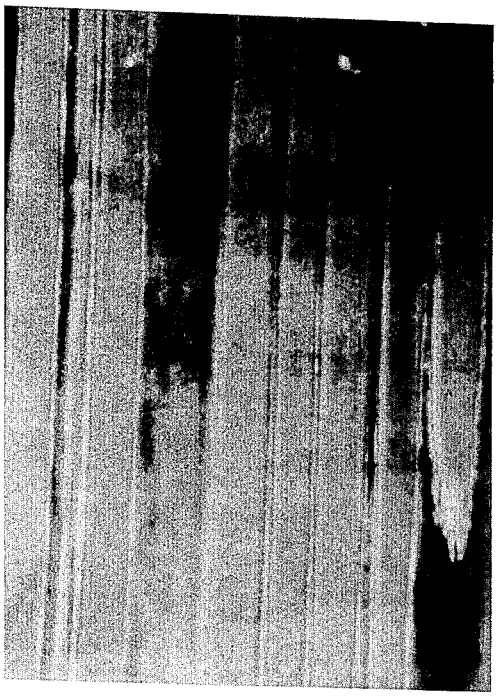
Figure 41:
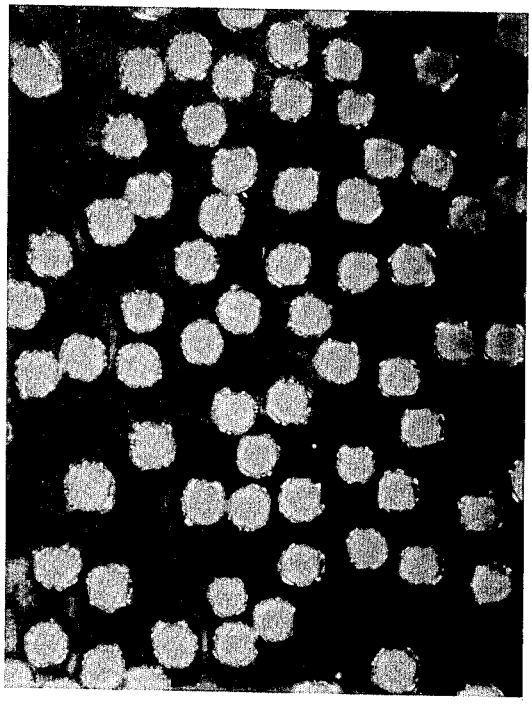
Figure 42:
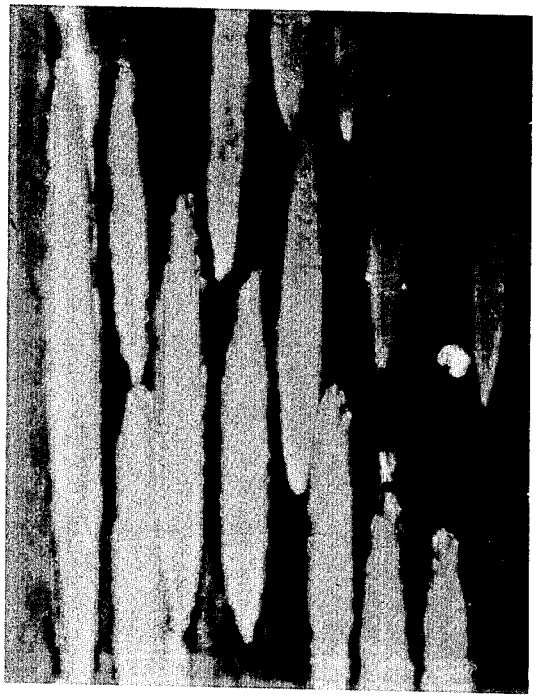

FIG. 39 is a photomicrograph under polarized light of cross-sections of carbon fibers produced from polyacrylonitrile fibers by first oxidizing the fibers under stress in air for about 12 hours at a temperature of 200–250° C., and then carbonizing to a temperature of 1400° C. FIG. 40 is a longitudinal view of like fibers. FIGS. 41 and 42 are photomicrographs under polarized light of cross sections and longitudinal sections, respectively, of carbon fibers produced in a similar manner except that the fibers were heated to a temperature of 2800° C. The photomicrographs have a magnification factor of 1000X. As in the case of the 400° C. heat-treated fibers whose photomicrographs are depicted in FIGS. 37 and 38, the fibers appear to be essentially homogeneous and do not exhibit the textural variations and fibrillar appearance of the fibers whose photomicrographs are depicted in FIGS. 15–22 and 24–25. It is evident from a comparison of FIGS. 39–42 to FIGS. 37 and 38 that such structure is not imparted to the fibers by heating to higher temperatures. (The white spots present in the photomicrographs are caused by the penetration of polishing compound into sample voids during the preparation of the samples.)

Figure 43:
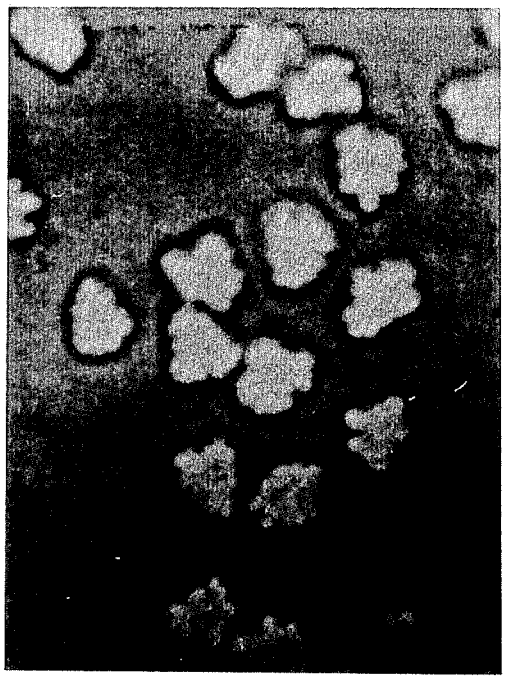
Figure 44:
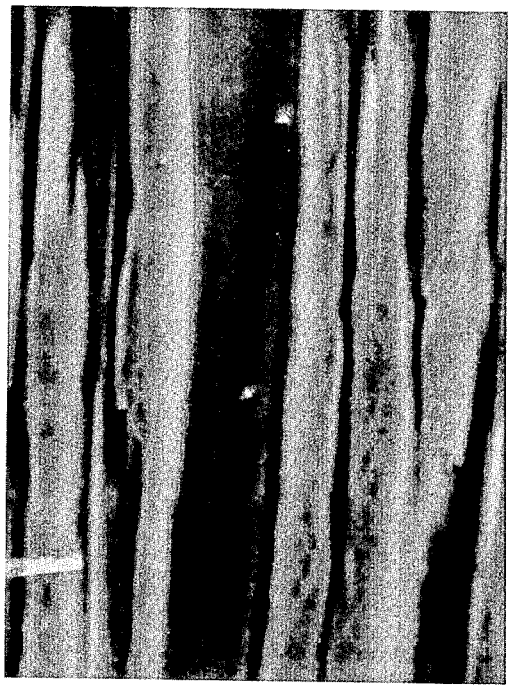

FIG. 43 is a photomicrograph under polarized light of cross sections of fibers produced from rayon fibers by first thermally stabilizing the fibers in air for a few minutes at a temperature of 260°–280° C., and then heating them in a nitrogen atmosphere to a temperature of 300° C.in less than one minute. FIG. 44 is a photomicrograph under C. in polarized light of longitudinal sections of like fibers. The photomicrographs have a magnification factor of 1000X. The fibers appear to be essentially homogeneous and do not exhibit the textural variations and fibrillar appearance of the fibers whose photomicrographs are depicted in FIGS. 15–22 and 24–25.

Figure 45:
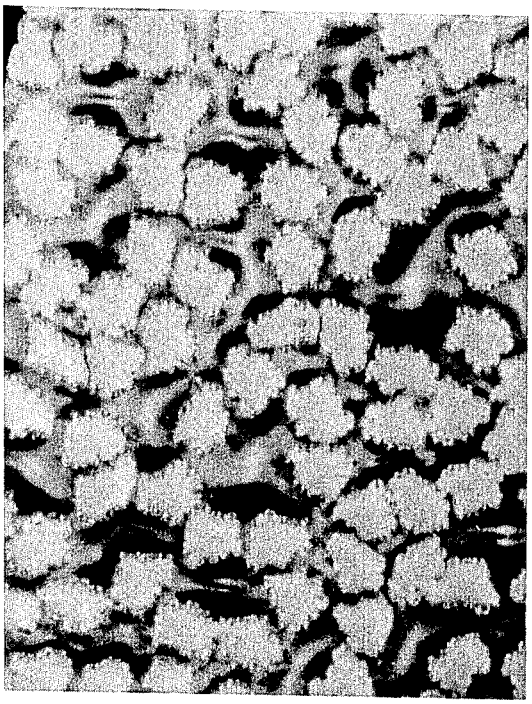
Figure 46:
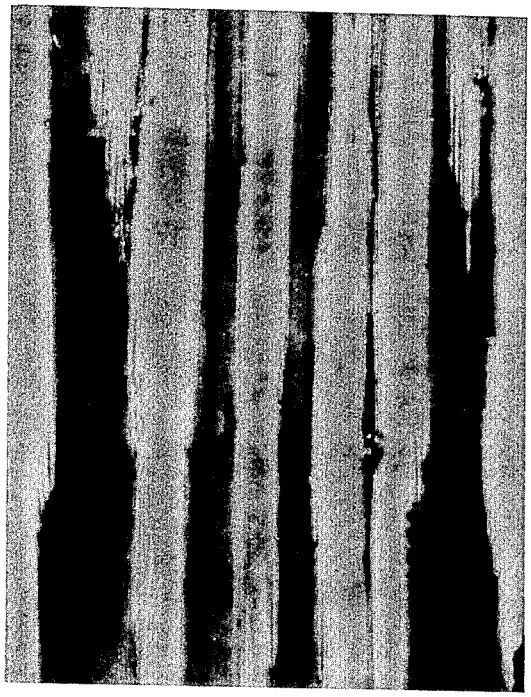
Figure 47:
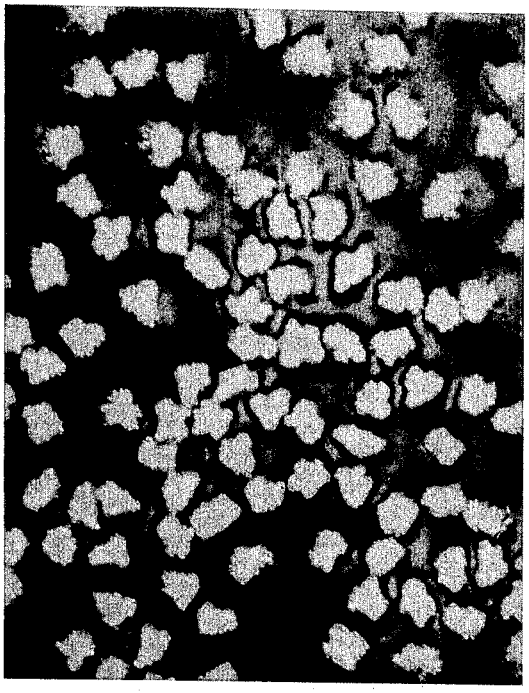
Figure 48:
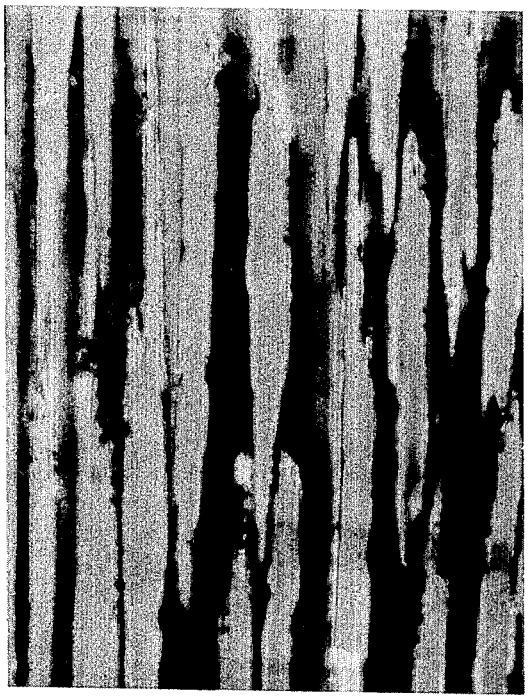

FIG. 45 is a photomicrograph under polarized light of cross sections of carbon fibers produced from rayon fibers by first thermally stabilizing the fibers in air for a few minutes at a temperature of 260°–280° C., and then carbonizing them in a nitrogen atmosphere to a temperature of 1300° C. in less than one minute. FIG. 46 is a longitudinal view of like fibers. FIGS. 47 and 48 are photomicrographs under polarized light of cross sections and longitudinal sections, respectively, of carbon fibers produced in a similar manner except that the fibers were heated to a temperature of 3000° C.[8] The photomicrographs have a magnification factor of 1000X. As in the case of the 300° C. heat-treated fibers whose photomicrographs are depicted in FIGS. 43 and 44, the fibers appear to be essentially homogeneous and do not exhibit the textural variations and fibrillar appearance of the fibers whose photomicrographs are depicted in FIGS. 15–22 and 24–25. It is evident from a comparison of FIGS. 45–48 to FIGS. 43 and 44 that such structure is not imparted to the fibers by heating to higher temperatures. (The white spots present in the photomicrographs are caused by the penetration of polishing compound into sample voids during the preparation of the samples.)

EXAMPLES

The following examples are set forth for purposes of illustration so that those skilled in the art may better understand the invention. It should be understood that they are exemplary only, and should not be construed as limiting the invention in any manner.

EXAMPLE 1

An acenaphthylene pitch was prepared by heating acenaphthylene to form a polymeric mixture, and then pyrolyzing the mixture by heating it under reflux for 6 hours. At the end of this time, air was bubbled through the pitch for about 7 hours while the pitch was maintained at a temperature of about 250° C. in order to remove acenapthene and other volatiles. The resulting pitch had a density of 1.29 grams/cc., a softening temperature of 234° C., and contained 0.6 per cent by weight quinoline insolubles (Q.I. was determined by quinoline extraction at 75° C.). Chemical analysis showed a carbon content of 94.91% and a hydrogen content of 4.49%.

A portion of the pitch produced in this manner was added to an extrusion cylinder and heated in the extruder to 400° C. over a two-hour period under a nitrogen atmosphere. The temperature of the pitch was then raised from 400° C. to 436° C. over a period of about 3.5 hours. When the pitch reached the latter temperature, a piston was used to apply pressure to the pitch while the molten pitch was extruded through a pin-hole orifice (diameter 0.015 inch) at the bottom of the extruder to produce a filament which was taken up by a reel at a rate of about 20 feet/minute. The filament passed through a nitrogen atmosphere as it left the extruder orifice and before it was taken up by the reel. A considerable quantity of fiber 20–30 microns in diameter was produced in this manner at a temperature between 436° C. and 440° C.

A sample of the pitch which had been heated at 438° C. was found to contain 88 per cent by weight pyridine insolubles, indicating a mesophase content of approximately 88 per cent (P.I. was determined by Soxhlet extraction in boiling pyridine). Fiber spun from this pitch was examined by X-ray diffraction techniques and shown to be highly oriented (the preferred orientation of the fiber, determined by microdensitometer scanning of the (002) band of the exposed X-ray film, was found to be 26° [FWHM]). The apparent stack height, $L_c$, of the aligned domains of pitch molecules in the fiber was determined by microdensitometer scanning of the width of the (002) diffraction arc to be 40 A. See FIG. 1 for the X-ray diffraction pattern of this fiber.

Polarized light microscopy examination of like fiber indicated the presence of large elongated anisotropic domains, having a fibrillar-shaped appearance, preferentially aligned parallel to the fiber axis.

A portion of the as-drawn fibers produced in this manner were heated to 343° C. in oxygen over a period of about one hour, and held at this temperature for about 6 minutes. The resulting oxidized fibers were totally infusible and could be heated at elevated temperatures without sagging.

The infusible fibers were heated to a temperature of 812° C. over a period of about 100 minutes in an argon atmosphere, and then to various temperatures up to 2000° C. in about one-half hour. In each instance the fibers were held at the final heat treatment temperature for about 10 minutes.

Fibers having diameters of less than 30 microns produced in this manner exhibited tensile strengths in excess of $100 \times 10^3$ psi. and Young's modulus of elasticity in excess of about $20 \times 10^6$ psi. Illustratively, fiber heated to 1200° C. had a tensile strength of $129 \times 10^3$ psi. and a Young's modulus of $23.1 \times 10^6$ psi. Fiber heated to 1400° C. had a tensile strength of $134 \times 10^3$ psi. and a Young's modulus of $26.3 \times 10^6$ psi., while fiber heated to 1600° C. had a tensile strength of $128 \times 10^3$ psi. and a Young's modulus of $34.8 \times 10^6$ psi.

X-ray diffraction studies of fibers prepared in a similar manner (by heating fibers produced from the same pitch to 350° C. in oxygen at a rate of 10° C./minute and subsequently carbonizing them by heating to a temperature of 1000° C. in an argon atmosphere over a period of one hour) showed such fibers to have a preferred orientation (FWHM) of 33° and an apparent stack height ($L_c$) of 19 A. The X-ray diffraction pattern of such fibers is shown in FIG. 9. FIG. 10 shows the X-ray diffraction pattern of the same fibers after being heated to 3000° C. The 3000° C. heat treated fibers had a preferred orientation of about 8° and an apparent layer size ($L_a$) and stack height ($L_c$) in excess of 1000 A.

Polarized light microscopy examination of fibers prepared in like manner but heat treated to 1605° C. indicated the presence of large oriented elongated graphitizable domains resembling those of the as-drawn fiber. Fibers prepared in the same manner but heat treated to 3000° C. likewise were characterized by large oriented elongated domains preferentially aligned parallel to the fiber axis (although now graphitic rather than graphitizable).

EXAMPLE 2

A commercial petroleum pitch was employed to produce a pitch having a mesophase content of about 50 per cent by weight. The precursor pitch had a density of 1.233 grams/cc., a softening temperature of 120.5° C. and contained 0.83 percent by weight quinoline insolubles (Q.I. was determined by quinoline extraction at 75° C.). Chemical analysis showed a carbon content of 93.3%, a hydrogen content of 5.6%, a sulfur content of 0.94% and 0.044% ash.

The mesophase pitch was produced by heating the precursor petroleum pitch at a temperature of about 400° C. for about 32 hours under a nitrogen atmosphere.

After heating, the pitch contained 49.3 per cent by weight quinoline insolubles, indicating that the pitch had a mesophase content of close to 50 percent. A portion of this pitch was transferred to the extrusion cylinder described in Example 1 and spun into fiber at a temperature of 372° C. employing spinning speeds of between 20 to 80 feet/minute. A nitrogen atmosphere was employed as in Example 1. Fiber of 12–23 microns in diameter was produced.

X-ray diffraction studies of fibers prepared in a similar manner (spun from the same pitch at a temperature of 350° C. after the pitch had been heated for 10 hours at 400° C.) showed such fiber to have a preferred orientation (FWHM) of 29° (determined by microdensitometer scanning of the (002) band of the exposed X-ray film). The apparent stack height, $L_c$, of the aligned domains of pitch molecules in the fiber was determined by microdensitometer scanning of the width of the (002) diffraction arc to be 47 A. See FIG. 2 for the X-ray diffraction pattern of this fiber.

Polarized light microscopy examination of like fiber indicated the presence of large elongated anisotropic domains, having a fibrillar-shaped appearance, preferentially aligned parallel to the fiber axis. See FIGS. 15 and 16.

A portion of the as-drawn fibers produced in this manner were heated to 300° C. in oxygen over a period of about one-half hour, and held at this temperature for about one-quarter hour. The resulting oxidized fibers were totally infusible and could be heated at elevated temperatures without sagging.

The infusible fibers were heated to a temperature of 800° C. over a period of about 80 minutes in a nitrogen atmosphere, held at this temperature for about 10 minutes, and then heated to a final temperature of between 1400° C. to 1800° C. in argon at a rate of 50° C.–100° C./minute. In each instance, the fibers were held at the final heat treatment temperature for about 15 minutes.

Fibers having tensile strengths in excess of $100 \times 10^3$ psi. and Young's modulus of elasticity in excess of about $20 \times 10^6$ psi, were prepared in this manner. Illustratively, fiber heated to 1600° C. had a tensile strength of $201 \times 10^3$ psi. and a Young's modulus of elasticity of $32.6 \times 10^6$ psi. Fiber heated to 1800° C. had a tensile strength of $149 \times 10^3$ psi. and a Young's modulus of $53.2 \times 10$ psi.

X-ray diffraction studies of fibers prepared in a similar manner (by heating fibers produced from the same pitch to 350° C. in oxygen at a rate of 10° C./minute and subsequently carbonizing them by heating to a temperature of 1000° C. in an argon atmosphere over a period of about one hour) showed such fibers to have a preferred orientation (FWHM) of 40° and an apparent stack height ($L_c$) of 21 A. The X-ray diffraction pattern of such fibers is shown in FIG. 11. FIG. 12 shows the X-ray diffraction pattern of the same fibers after being heated to 3000° C. The 3000° C. heat treated fiber had a preferred orientation of about 8° and an apparent layer size ($L_a$) and stack height ($L_c$) in excess of 1000 A.

Polarized light microscopy examination of fibers prepared in like manner but heat treated to 1675° C. indicated the presence of large oriented elongated graphitizable domains resembling those of the as-drawn fiber. Fibers prepared in the same manner but heat treated to 3000° C. likewise were characterized by large oriented elongated domains preferentially aligned parallel to the fiber axis (although now graphitic rather than graphitizable). See FIGS. 17–20.

Fibers prepared in like manner and heated to temperatures in excess of 3000° C. have been found to have tensile strengths in excess of $300 \times 10^3$ psi. and Young's modulus in excess of $100 \times 10^6$ psi.

What is claimed is:

1. A fiber having a structure possessing the three-dimensional order characteristic of polycrystalline graphite, said fiber having a diameter no greater than 30 microns; an electrical resistivity less than $250 \times 10^{-6}$ ohm centimeters; a tensile strength greater than $200 \times 10^3$ psi.; a Young's modulus of elasticity greater than $50 \times 10^6$ psi.; an X-ray diffraction pattern characterized by the presence of the (112) cross-lattice line, and resolved (100) and (101) lines; a preferred orientation of carbon crystallites parallel to the fiber axis such that the preferred orientation parameter for the fiber is no greater than 10° (determined by microdensitometer scanning of the (002) band of the exposed X-ray film of the fiber and expressed as the full width at half maximum of the azimuthal intensity distribution); an interlayer spacing *d* no greater than 3.37 A; and containing oriented elongated domains preferentially aligned parallel to the fiber axis, said domains characteristically being greater than 5000 A in diameter and visible under polarized light at a magnification of 1000 X.

2. The fiber as in claim 1 having an electrical resistivity of from $150 \times 10^{-6}$ ohm centimeters to $200 \times 10^{-6}$ ohm centimeters, a tensile strength greater than $250 \times 10^3$ psi., and a Young's modulus of elasticity greater than $75 \times 10^6$ psi.

3. The fiber as in claim 1 containing elongated domains from 10,000 A to 40,000 A in diameter.

4. The fiber as in claim 3 having an electrical resistivity of from $150 \times 10^{-6}$ ohm centimeters to $200 \times 10^{-6}$ ohm centimeters, a tensile strength greater than $250 \times 10^3$ psi., and a Young's modulus of elasticity greater than $75 \times 10^6$ psi.

5. The fiber as in claim 1 containing elongated domains from 10,000 A to 100,000 A in diameter.

6. A carbon fiber capable of being converted thermally to a fiber having a structure possessing the three-dimensional order characteristic of polycrystalline graphite, said carbon fiber having a diameter no greater than 30 microns; a preferred orientation of carbon crystallites parallel to the fiber axis such that the preferred orientation parameter for the fiber is less than 45° (determined by microdensitometer scanning of the (002) band of the exposed X-ray film of the fiber and expressed as the full width at half maximum of the azimuthal intensity distribution); and containing at least 40 per cent of oriented elongated domains preferentially aligned parallel to the fiber axis, said domains characteristically being greater than 5000 A in diameter and visible under polarized light at a magnification of 1000 X.

7. The carbon fiber as in claim 6 containing essentially 100 per cent of oriented elongated domains preferentially aligned parallel to the fiber axis.

8. The carbon fiber as in claim 6 containing elongated domains from 10,000 A to 40,000 A in diameter.

9. The carbon fiber as in claim 6 containing elongated domains from 10,000 A to 100,000 A in diameter.

10. A carbonaceous pitch fiber capable of being thermoset and converted thermally to a fiber having a structure possessing the three-dimensional order characteristic of polycrystalline graphite, said pitch fiber having a mesophase content of from 40 per cent by weight to 90 per cent by weight, a diameter no greater than 30 microns, a preferred orientation of pitch molecules parallel to the fiber axis such that the preferred orientation parameter for the fiber is from 20° to 35° (determined by microdensitometer scanning of the (002) band of the exposed X-ray film of the fiber and expressed as the full width at half maximum of the azimuthal intensity distribution), and containing elongated domains of oriented molecules preferentially aligned parallel to the fiber axis, said domains characteristically being greater than 5000 A in diameter and visible under polarized light at a magnification of 1000 X.

11. The carbonaceous pitch fiber as in claim 10 containing elongated domains from 10,000 A to 40,000 A in diameter.

12. The carbonaceous pitch fiber as in claim 10 having a mesophase content of from 45 per cent by weight to 65 per cent by weight.

13. The carbonaceous pitch fiber as in claim 12 containing elongated domains from 10,000 A to 40,000 A in diameter.

14. A process for producing a carbon fiber capable of being converted thermally to a fiber having a structure possessing the three-dimensional order characteristic of polycrystalline graphite, said carbon fiber having a diameter no greater than 30 microns and a preferred orientation of carbon crystallites parallel to the fiber axis such that the preferred orientation parameter for the fiber is less than 45° (determined by microdensitometer scanning of the (002) band of the exposed X-ray film of the fiber and expressed as the full width at half maximum of the azimuthal intensity distribution), which comprises spinning a carbonaceous fiber having a diameter no greater than 30 microns from a carbonaceous pitch containing from 40 per cent by weight to 90 per cent by weight mesophase, which mesophase, under quiescent conditions, forms a homogeneous bulk mesophase which when examined under polarized light exhibits large coalesced domains in excess of 200 microns in size, said pitch being nonthixotropic and having a viscosity of 10 poises to 200 poises at the temperature of spinning; heating the spun fiber in an oxygen-containing atmosphere at a temperature of from 250° C. to 400° C. for a time sufficient to render it infusible; and then heating the infusible fiber so produced in an inert atmosphere to a temperature of at least 1000° C.

15. The process as in claim 14 wherein the fiber is heated in an oxygen-containing atmosphere at a temperature of from 300° C. to about 390° C.

16. The process as in claim 15 wherein the oxygen-containing atmosphere is selected from the group consisting of air and oxygen.

17. The process as in claim 14 wherein the carbonaceous fiber is spun at a temperature at which the pitch has a viscosity of 30 poises to 60 poises.

18. The process as in claim 17 wherein the fiber is heated in an oxygen-containing atmosphere at a temperature of from 300° C. to about 390° C.

19. The process as in claim 18 wherein the oxygen-containing atmosphere is selected from the group consisting of air and oxygen.

20. The process as in claim 17 wherein the pitch contains from 45 per cent by weight to about 65 per cent by weight mesophase.

21. The process as in claim 20 wherein the fiber is heated in an oxygen-containing atmosphere at a temperature of from 300° C. to about 390° C.

22. The process as in claim 21 wherein the oxygen-containing atmosphere is selected from the group consisting of air and oxygen.

23. A process for producing a fiber having a structure possessing the three-dimensional order characteristic of polycrystalline graphite, said fiber having a diameter no greater than 30 microns and a preferred orientation of carbon crystallites parallel to the fiber axis such that the preferred orientation parameter for the fiber is no greater than 10° (determined by microdensitometer scanning of the (002) band of the exposed X-ray film of the fiber and expressed as the full width at half maximum of the azimuthal intensity distribution), which comprises spinning a carbonaceous fiber having a diameter no greater than 30 microns from a carbonaceous pitch containing from 40 per cent by weight to 90 per cent by weight mesophase, which mesophase, under quiescent conditions, forms a homogeneous bulk mesophase which when examined under polarized light exhibits large coalesced domains in excess of 200 microns in size, said pitch being nonthixotropic and having a viscosity of 10 poises to 200 poises at the temperature of spinning; heating the spun fiber in an oxygen-containing atmosphere at a temperature of from 250° C. to 400° C. for a time sufficient to render it infusible; and then heating the infusible fiber so produced in an inert atmosphere first to a temperature of at least 1000° C., and then to a higher temperature of at least 2500° C.

24. The process as in claim 23 wherein the fiber is heated in an oxygen-containing atmosphere at a temperature of from 300° C. to about 390° C.

25. The process as in claim 24 wherein the oxygen-containing atmosphere is selected from the group consisting of air and oxygen.

26. The process as in claim 23 wherein the carbonaceous fiber is spun at a temperature at which the pitch has a viscosity of 30 poises to 60 poises.

27. The process as in claim 26 wherein the fiber is heated in an oxygen-containing atmosphere at a temperature of from 300° C. to about 390° C.

28. The process as in claim 27 wherein the oxygen-containing atmosphere is selected from the group consisting of air and oxygen.

29. The process as in claim 26 wherein the pitch contains from 45 per cent by weight to about 65 per cent by weight mesophase.

30. The process as in claim 29 wherein the fiber is heated in an oxygen-containing atmosphere at a temperature of from 300° C. to about 390° C.

31. The process as in claim 30 wherein the oxygen-containing atmosphere is selected from the group consisting of air and oxygen.

32. A process for producing a carbonaceous pitch fiber capable of being thermoset and converted thermally to a fiber having a structure possessing the three-dimensional order characteristic of polycrystalline graphite, said pitch fiber having a mesophase content of from 40 per cent by weight to 90 per cent by weight, a diameter no greater than 30 microns, a preferred orientation of pitch molecules parallel to the fiber axis such that the preferred orientation parameter for the fiber is from 20° to 35° (determined by microdensitometer scanning of the (002) band of the exposed X-ray film of the fiber and expressed as the full width at half maximum of the azimuthal intensity distribution), and containing elongated domains of oriented molecules preferentially aligned parallel to the fiber axis, said domains characteristically being greater than 5000 A in diameter and visible under polarized light at a magnification of 1000 X, which comprises spinning a carbonaceous fiber having a diameter no greater than 30 microns from a carbonaceous pitch containing from 40 per cent by weight to 90 percent by weight mesophase, which mesophase, under quiescent conditions, forms a homogeneous bulk mesophase which when examined under polarized light exhibits large coalesced domains in excess of 200 microns in size, said pitch being non-thixotropic and having a viscosity of 10 poises to 200 poises at the temperature of spinning.

33. A carbonaceous pitch fiber produced by the process of claim 32.

34. A carbon fiber produced by the process of claim 14.

35. A fiber produced by the process of claim 23.

* * * * *